US007808439B2

(12) United States Patent
Yang et al.

(10) Patent No.: US 7,808,439 B2
(45) Date of Patent: Oct. 5, 2010

(54) SUBSTRATE INTEGRATED WAVEGUIDE ANTENNA ARRAY

(75) Inventors: Songnan Yang, San Jose, CA (US); Aly E. Fathy, Knoxville, TX (US)

(73) Assignee: University of Tennessee Reserch Foundation, Knoxville, TN (US)

( * ) Notice: Subject to any disclaimer, the term of this patent is extended or adjusted under 35 U.S.C. 154(b) by 221 days.

(21) Appl. No.: 12/205,785

(22) Filed: Sep. 5, 2008

(65) Prior Publication Data

US 2009/0066597 A1 Mar. 12, 2009

Related U.S. Application Data

(60) Provisional application No. 60/970,551, filed on Sep. 7, 2007.

(51) Int. Cl.
*H01Q 13/10* (2006.01)

(52) U.S. Cl. ..... 343/771; 343/770

(58) Field of Classification Search ..... 343/771, 343/770, 768, 772, 853; 342/361
See application file for complete search history.

(56) References Cited

U.S. PATENT DOCUMENTS 3,720,953 A * 3/1973 Ajioka ..... 343/771
4,266,228 A * 5/1981 Perrotti ..... 343/771
4,916,458 A * 4/1990 Goto ..... 343/771
5,311,200 A * 5/1994 Walker et al. ..... 343/771
5,579,019 A * 11/1996 Uematsu et al. ..... 343/771
7,286,093 B2 * 10/2007 Artis et al. ..... 343/771

OTHER PUBLICATIONS

Yang, S., et al., "Slotted Arrays for Mobile DBS Antennas," Proc. 2005 Antenna Applications Symposium, pp. 496-509 (Sep. 21-23, 2005).
Deslandes, D., et al., "Integrated Microstrip and Rectangular Waveguide in Planar Form," IEEE Microwave and Wireless Components Letters, v.11, No. 2, pp. 68-70 (Feb. 2001).
Yang, S., et al., "Slotted Arrays for Low Profile Mobile DBS Antennas," Proc. Antennas and Propagation Society Int'l Symp, (Jul. 2005).
Yang, S., et al., "Ku-band Slot Array Antennas for Low Profile Mobile DBS Applications: Printed vs. Machined," Proceedings of Antennas and Propagation Soc. Int'l Symp (Jul. 2006).

(Continued)

*Primary Examiner*—Tho G Phan
(74) *Attorney, Agent, or Firm*—Pitts & Brittian, P.C.

(57) ABSTRACT

A substrate integrated waveguide (SIW) slot full-array antenna fabricated employing printed circuit board technology. The SIW slot full-array antenna using either single or multi-layer structures greatly reduces the overall height and physical steering requirements of a mobile antenna when compared to a conventional metallic waveguide slot array antenna. The SIW slot full-array antenna is fabricated using a low-loss dielectric substrate with top and bottom metal plating. An array of radiating cross-slots is etched in to the top plating to produce circular polarization at a selected tilt-angle. Lines of spaced-apart, metal-lined vias form the side-walls of the waveguides and feeding network. In multi-layer structures, the adjoining layers are coupled by transverse slots at the interface of the two layers.

15 Claims, 32 Drawing Sheets

OTHER PUBLICATIONS

Yang, S., et al., "Development of a Slotted Substrate Integrated Waveguide (SIW) Array Antennas for Mobile DBS Applications," Proc. Antennas Applications Symp. (Sep. 2006).
Hirokawa, J., et al., "An Analysis of a Waveguide T junction with an Inductive Post," IEEE Trans. Microwave Theory and Techniques, v. 39, pp. 563-566 (Mar. 1991).
Yang, S., et al., "Synthesis of a Compound T junction for a Two-Way Splitter with Arbitrary Power Ratio," 2005 IEEE Microwave Theory and Techniques Society Int'l Symp. Digest, pp. 985-988, (Jun. 2005).
Deslandes, D., et al., "Analysis and Design of Current Probe Transition From Grounded Coplanar to Substrate Integrated Rectangular Waveguides," IEEE Trans. Microwave Theory & Techniques, v. 53, No. 8, pp. 2487-2495 (Aug. 2005).
Getsinger, W. J., "Elliptically Polarized Leaky-Wave Array", IRE Trans. Antennas and Propagation, v. 10, pp. 165-171 (Mar. 1962).
Suleiman, S., et al., "Evaluation of a Ku Band Slotted Array Antenna Using Planar Near-Field Measurements," 2006 IEEE AP-S Int'l Symposium on Antennas and Propagation, pp. 433-436 (Jul. 13-17, 2006).
Takahashi, T., et al., "A Single-Layer Power Divider for a Slotted Waveguide Array Using π-Junctions with an Inductive Wall," IEICE Trans. Communications, v. E79-B, No. 1, pp. 57-62 (Jan. 1996).
Fukazawa, K., et al., "Two-Way Power Divider for Partially Parallel Feed in Single-Layer Slotted Waveguide Arrays," IEICE Trans. Communications, v. E81-B, No. 6, pp. 1248-1253, (Jun. 1998).
Simmons, A. J., "Circularly Polarized Slot Radiators," IRE Trans. on Antennas and Propagation, v. 5, pp. 31-36 (Jan. 1957).
Hirokawa, J., et al., "A Single-Layer Slotted Leaky Waveguide Array Antenna for Mobile Reception of Direct Broadcast from Satellite," IEEE Trans. Vehicular Technology, v. 44, pp. 749-755 (Nov. 1995).
Sakakibara, K., et al., "A Two-Beam Slotted Leaky Waveguide Array for Mobile Reception of Dual-Polarization DBS," IEEE Trans. Vehicular Technology, v. 48, No. 1, pp. 1-7 (Jan. 1999).
Yang, S., et al., "Cavity-Backed Patch Shared Aperture Antenna Array Approach for Mobile DBS Applications," 2006 IEEE Antennas and Propagation Int'l Symposium (Jul. 13-17, 2006).
Balanis, C. A., Advanced Engineering Electromagnetics, New York, Wiley, pp. 376-383.

* cited by examiner

SUBSTRATE INTEGRATED WAVEGUIDE ANTENNA ARRAY

CROSS-REFERENCE TO RELATED APPLICATIONS

This application claims the benefit of U.S. Provisional Application No. 60/970,551 filed Sep. 7, 2007.

STATEMENT REGARDING FEDERALLY SPONSORED RESEARCH OR DEVELOPMENT

Not Applicable

BACKGROUND OF THE INVENTION

1. Field of Invention

The present invention pertains to the field of antennas used in communications. Particularly, this invention is related to a substrate integrated waveguide (SIW) antenna array for use in communications including, but not limited to, mobile direct broadcast satellite reception.

2. Description of the Related Art

The basic antenna requirements for mobile direct broadcast satellite (DBS) reception in the United States include: (1) dual circular polarization, (2) a gain of approximately 32 dBi, and (3) full steering in two planes for satellite tracking with a 360° steering range in the azimuth and a 50° steering range in the elevation from 20° to 70° above horizon. When using a flat-plate phased-array antenna structure, the beam must be tilted to 20° relative to horizon to accommodate the full steering range requirements. At this angle, the gain drops significantly and the cross-polarization level becomes unacceptably high. As a result, antennas using mechanical steering have been evaluated. These antennas have a fixed broadside beam that is mechanically tilted/rotated in both the elevation and azimuth planes to provide the required beam steering. Compared to the phased-array antennas, the mechanically-steered antennas are generally less expensive. However, the large scanning volume of the mechanically-steered antennas produces an unacceptable overall antenna height.

Previously, a single waveguide slot array comprised of 6 radiating waveguides has been designed and prototyped by the inventors of the present invention. (See Songnan Yang and Aly E. Fathy, "Slotted Arrays for Mobile DBS Antennas," *Proceedings of the* 2005 *Antenna Applications Symposium,* pp. 496-509, 21-23 Sep. 2005, Monticello, Ill.). The prototypes are fabricated using CNC machining and their measured results were very encouraging. However, these designs suffered from the prohibiting cost of manufacturing, as well their heavy weight.

Recently, substrate integrated waveguide (SIW) technology was introduced as a low-cost solution for microwave systems where the waveguide components are fabricated using standard PCB processes on dielectric substrates for mm-wave applications. (See D. Deslandes and K. Wu, "Integrate microstrip and rectangular waveguide in planar form." *IEEE Microw. Guided Wave Lett.*, vol. 11, no. 2, pp. 68-70, February 2001).

The present inventors have participated in previous development of related antenna arrays, but have found the results lacking. One previous development was the design and fabrication of an all-metallic array, which was very expensive and heavy to produce. (See S. Yang and A. E. Fathy, "Slotted arrays for low profile mobile DBS antennas," presented at Proc. Antennas and Propagation Society Int. Symp., Washington, D.C., July 2005). Another previous development was a single layer 12×16 SIW sub-array, which occupied a relatively large area. (See S. Yang, S. H. Suleiman, and A. E. Fathy, "Ku-band Slot Array Antennas for Low Profile Mobile DBS Applications: Printed vs. Machined," presented at Proc. Antennas and Propagation Society Int. Symp., Washington, D.C., July 2006). Most recently, the present inventors developed a single layer 12×64 full-array that suffered from low efficiency. (S. Yang, S. H. Suleiman, and A. E. Fathy, "Development of a Slotted Substrate Integrated Waveguide (SIW) Array Antennas for Mobile DBS Applications," presented at Proc. Antennas Applications. Symp., Montecello, Ill., September 2006).

BRIEF SUMMARY OF THE INVENTION

A substrate integrated waveguide (SIW) slot full-array antenna fabricated employing printed circuit board technology. The SIW slot full-array antenna using either single or multi-layer structures greatly reduces the overall height and physical steering requirements of a mobile antenna when compared to a conventional metallic waveguide slot array antenna. The SIW slot full-array antenna is fabricated using a low-loss dielectric substrate with top and bottom metal plating. An array of radiating cross-slots is etched in to the top plating to produce circular polarization at a selected tilt-angle. Lines of spaced-apart, metal-lined vias form the sidewalls of the waveguides and feeding network. In multi-layer structures, the adjoining layers are coupled by transverse slots at the interface of the two layers.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A low-profile, steerable antenna is shown and described herein. The low-profile, steerable antenna is a leaky-wave slot-array antenna radiating at an inherent tilt angle, which reduces the scan volume requirements significantly. The leaky-wave slot-array antenna uses printed circuit substrates using substrate integrated waveguide (SIW) technology.

Conventionally, both the slot-array antennas and their associated feed networks are fabricated using metallic waveguides due to the extremely low loss performance. However, metallic waveguide slot array antennas are bulky, heavy, and expensive to fabricate. In order to extend the well-known design rules of the metallic waveguide slot arrays to SIW designs, the present inventors have extensively studied the parameters of SIW structures, including the use of Ansoft HFSS™ to develop an equivalent conventional dielectrically-loaded waveguide to represent the SIW structure and perform a full-wave 3D analysis. This equivalent structure allows estimate the complex propagation characteristics of the SIW guides using the known waveguide expressions. Based on the results of the study, the present inventors have developed design charts useful in the selection of the dielectric material and the SIW dimensions.

The primary elements of a slotted SIW antenna array include (1) substrate integrated waveguides with low loss to construct the feed network, (2) a binary feed network based on waveguide "T"-junctions to achieve adequate bandwidth and good phase balance at the inputs of all radiating waveguides, (3) a smooth coaxial line to SIW transition through a grounded GCPW, and (4), for US DBS reception, "X"-slotted radiating SIWs with properly spaced slots to create circularly polarized beams at 45° off broadside. One skilled in the art will appreciate that 45° tilt and other design parameters depending upon the intended application of the SIW array.

Figure 1:
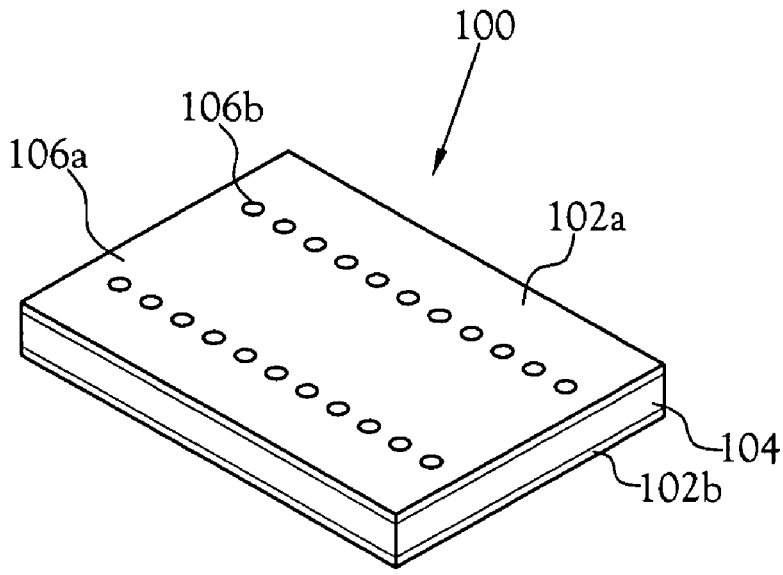
FIG. 1 is a perspective view of one embodiment of a substrate integrated waveguide (SIW) defined on a dielectric substrate.
Figure 2:
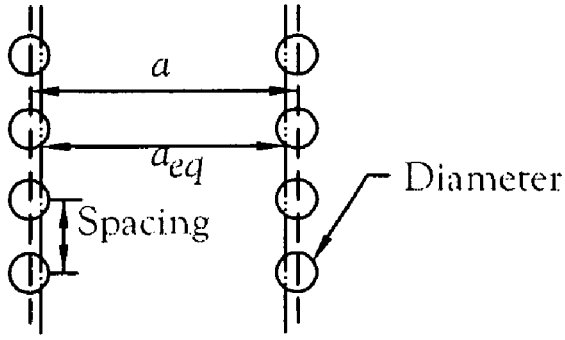
FIG. 2 is a top plan view illustrating the basic dimensional parameters of the SIW of FIG. 1.

Looking first at the design of a low-loss SIW, FIG. 1 illustrates a basic SIW 100. The SIW 100 begins with a dielectric substrate 104, such as a printed circuit board. Metal plates 102*a*, 102*b* cover the top and bottom faces of the dielectric substrate 104. Rather than using solid fences or plating the sides of the dielectric substrate 104, two rows of spaced-apart plated vias, or posts, 106*a*, 106*b* form the sidewalls of the waveguide and define a channel through the dielectric substrate 104. FIG. 2 illustrates the dimensional parameters of the SIW 100, which are discussed in detail below.

To develop an equivalent to the a dimension as a function of the diameter and spacing of the posts, an extensive 3D electromagnetic field simulation was carried out. For purposes of the simulation, the top walls, the bottom walls, and the posts were assumed to be perfect conductors. In addition, absorbing boundary conditions were applied along the SIW walls to allow energy to leak through the gaps between the posts. The dielectric was assumed to be lossless and to have a relative permittivity, $\epsilon_r$, of 2.2 to perform this simulation as most of the low-loss dielectric printed circuit board materials are close to this value. The a dimension was selected to be 13.5 mm, which establishes the center frequency of the operating band at 12.45 GHz with a single waveguide mode operation. A thickness of 3.175 mm was used to ensure only $TE_{10}$ mode propagation.

Figure 3:
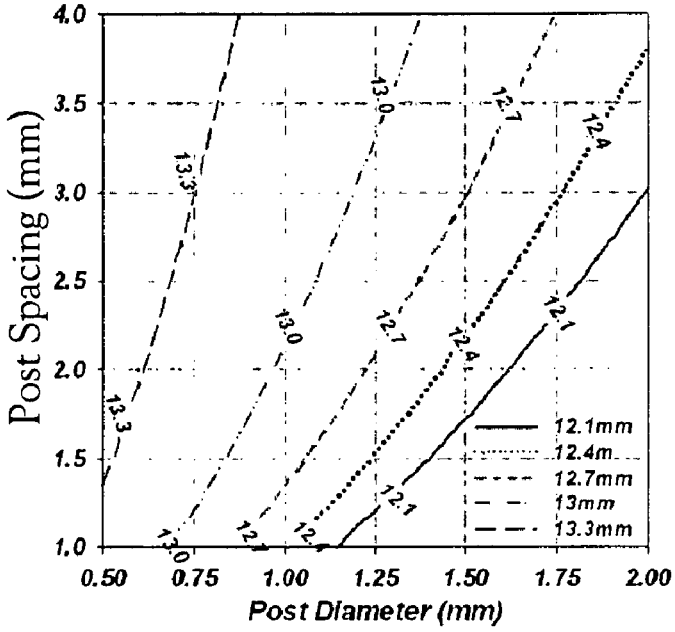
FIG. 3 is a contour plot of the equivalent waveguide dimensions, $a_{eq}$, of the SIW of FIG. 1 as a function of post diameter and post spacing.

The propagation constants of each diameter-and-spacing combination of these posts was theoretically estimated. The phase of the scattering matrix was extracted and compared to that of the regular dielectrically loaded waveguide, given that the propagation constant of the conventional waveguide is calculated based on the well known expression:

$$\beta_z = \beta\sqrt{1-\left(\frac{\lambda}{2a}\right)^2} = \frac{2\pi}{\lambda}\sqrt{1-\left(\frac{\lambda}{2a}\right)^2} \tag{1}$$

where $\lambda=\lambda_0/\sqrt{\epsilon_r}$ and $\lambda_0$ is the wavelength in free space. FIG. 3 is a contour plot of the extracted equivalent waveguide width, $a_{eq}$, of a SIW for different post parameters. Based on the simulation, the $a_{eq}$ dimension is smaller than the actual lateral spacing of the posts due to the reactive loading but tends to increase whenever thinner or widely spaced posts are used.

Figure 4:
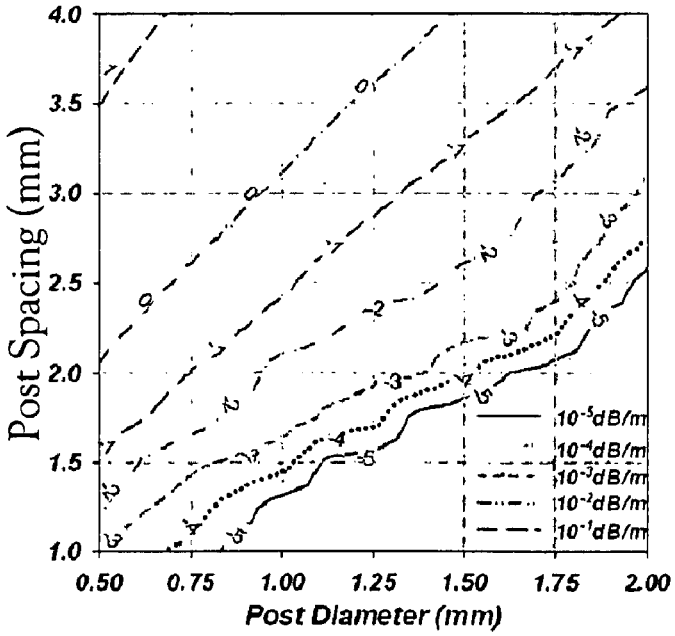
FIG. 4 is a logarithmic scale contour plot of the unit loss of the SIW of FIG. 1 as a function of post diameter and post spacing.

In the equivalent structure, the sidewalls of the SIW structure are represented by a lossy reactive load. The losses are due to the leakage through the area between the posts. The leakage loss, $L_{leakage}$, together with the dielectric loss, $L_{dielectric}$, and the conductor loss, $L_{conductor}$, contribute to the total losses of the SIW feeding structure. The leakage coefficient of the SIW structure is estimated using predictions of the transmitted power of the lossless SIW structure. The calculated drop in the transmitted power is related to the leakage loss. FIG. 4 shows the unit loss of the SIW structure as a function of post diameter and post spacing.

One of ordinary skill in the art will recognize that it is not practical to implement extremely closely spaced posts to minimize leakage loss. On the other hand, as the post spacing increase, the leakage effects increase. At some point, the leakage effects become unacceptably high, and the SIW can no longer be used to build a feeding network for the antenna array. However, it is foreseeable that a viable leaky-wave antenna could be designed using this high leakage feature of the SIW structure. Ultimately, use of a SIW requires compromise between increased leakage loss and reduced fabrication cost when compared to conventional metallic waveguides.

Figure 5A:
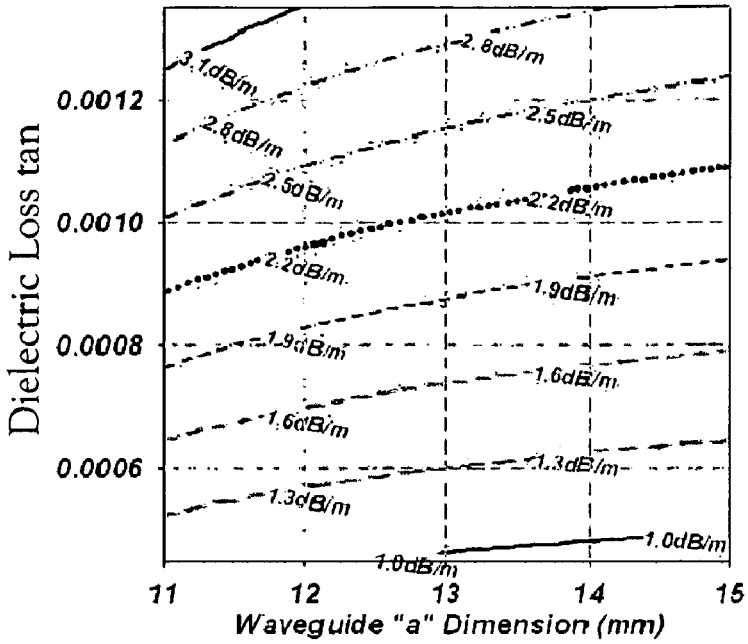
FIG. 5A is a contour plot of the dielectric loss of the SIW of FIG. 1 as a function of the dielectric loss tangent and the a dimension calculated using Equation 2.
Figure 5B:
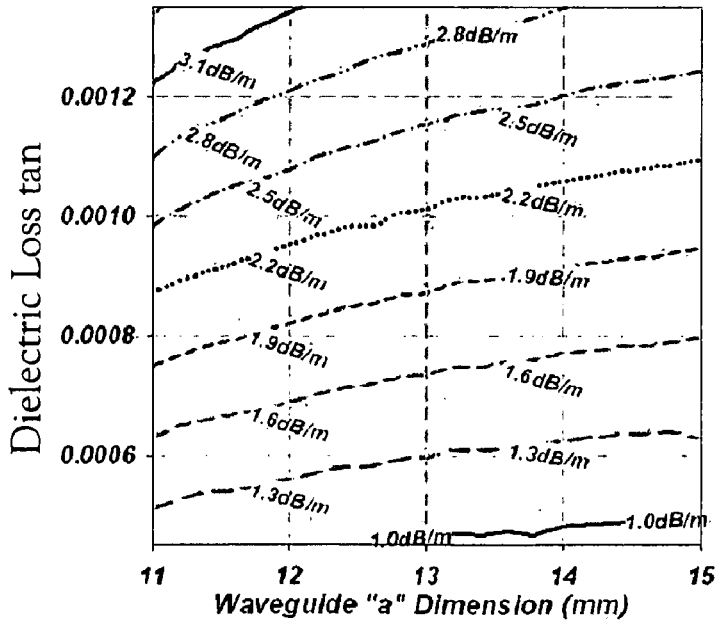
FIG. 5B is a contour plot of the dielectric loss of the SIW of FIG. 1 as a function of the dielectric loss tangent and the a dimension obtained from a simulation using Ansoft HFSS™.

The SIW dielectric loss is estimated using the well known dielectric loss formulas of a dielectrically loaded waveguide in association with the equivalent width. The dielectric losses are given by $$L_{dielectric} \cong \frac{\varepsilon''}{\varepsilon'}\frac{\pi}{\lambda^2}\frac{\lambda}{\sqrt{1-(f_c/f)^2}} = \tan\delta\frac{\pi}{\lambda}\left(\frac{\lambda_g}{\lambda}\right)(\text{Np/m}), \tag{2}$$

where $\epsilon'$ is the real part and $\epsilon''$ is the imaginary part of the complex dielectric constant of the lossy dielectric loading, $\lambda$ is the wavelength and $\lambda_g$ is the guided wavelength in a dielectric media, and tan $\delta$ is the dielectric loss tangent. FIG. 5A is a contour plot of the dielectric loss for a set of different materials obtained using Equation 2. FIG. 5B is a contour plot of the same structure simulated using HFSS. The correlation of the simulated results with the calculated results validates the use of Equation 2 to predict SIW dielectric losses.

The selection of the dielectric material is extremely important step when designing large arrays. The dielectric loss could be relatively high (1 dB/m) even for a substrate dielectric loss tangent as low as 0.00045. Hence, it is recognized that for regular high frequency laminate materials (tan δ~0.0009 and up), the dielectric losses are prohibitively large if the antenna array is large, especially when long feed lines are required.

Similar to the dielectric loss, the conductor loss is approximated using the rectangular waveguide equations after accounting for the extra loss in the sidewalls, which results from their construction using plated vias. In addition, the surface roughness of the plated metal layers (usually copper) degrades the conductivity of the equivalent waveguide walls. The conduction loss of $TE_{10}$ wave propagating in a single mode rectangular waveguide is given by $$L_{conductor} = L_{sidewalls} + L_{top\&bottom} = \frac{2R_{s1}}{\eta a}\frac{(f_c/f)^2}{\sqrt{1-(f_c/f)^2}} + \frac{R_{s2}}{\eta b}\frac{1}{\sqrt{1-(f_c/f)^2}} \text{ (Np/m)}, \tag{3}$$

where $R_{s1}$ and $R_{s2}$ represent the real part of the complex surface impedances of the sidewalls and the top and bottom conductors respectively, which are approximated using $$R_s = \Re\left\{\sqrt{\frac{j\omega\mu}{\sigma + j\omega\varepsilon}}\right\} \cong \sqrt{\frac{\omega\mu}{2\sigma}} \text{ (Ohm)} \tag{4}$$

and $$\eta = \sqrt{\frac{\mu_0}{\varepsilon_0\varepsilon_r}}. \tag{5}$$

Figure 6A:
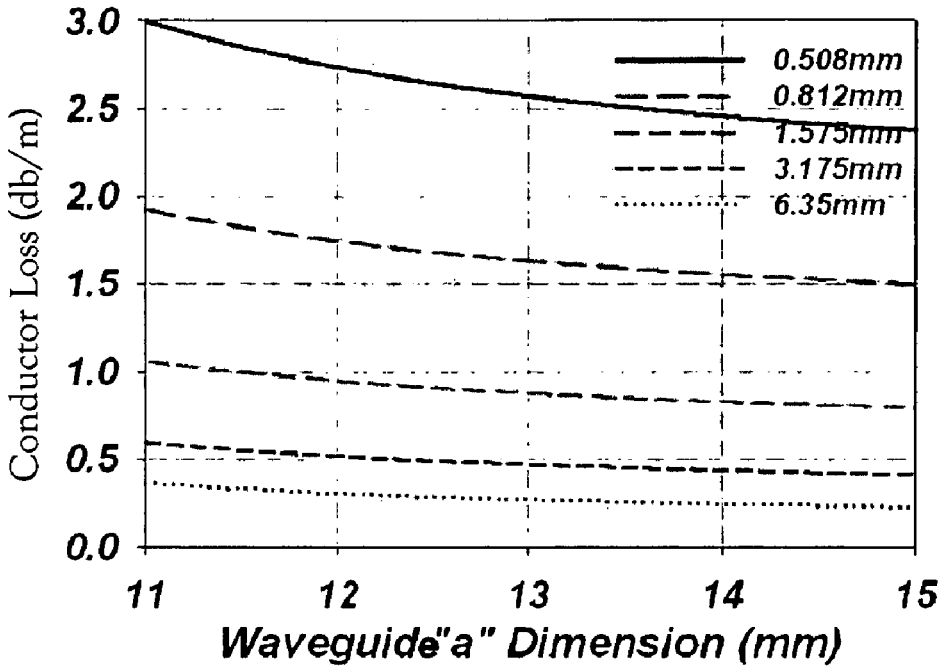
FIG. 6A is a contour plot of the conductor loss of the SIW of FIG. 1 as a function of the waveguide substrate thickness and the waveguide a dimension calculated using Equation 2.
Figure 6B:
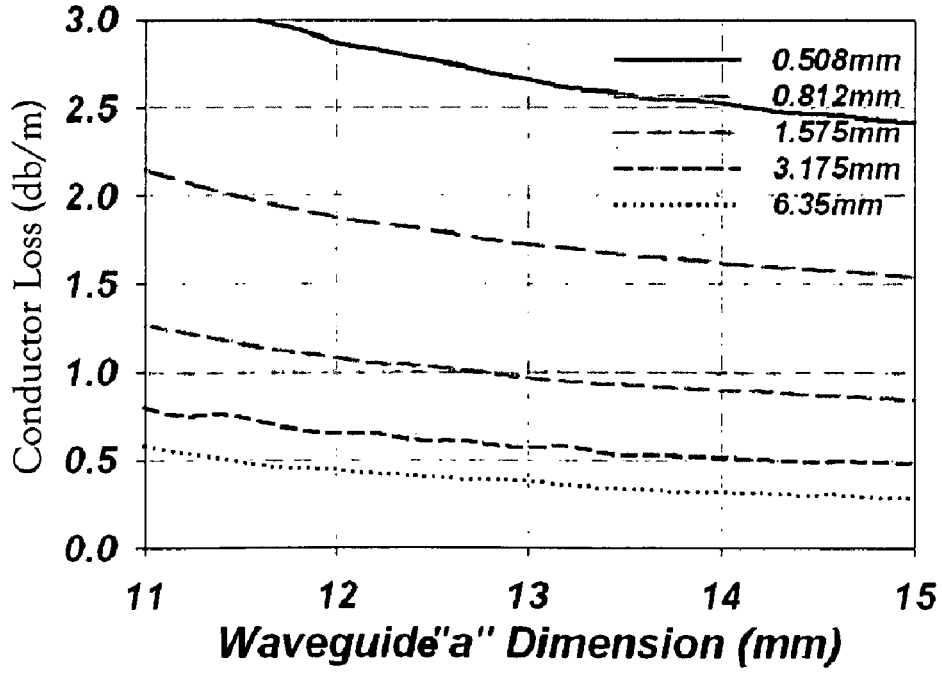
FIG. 6B is a contour plot of the conductor loss of the SIW of FIG. 1 as a function of the waveguide substrate thickness and the a dimension obtained from a simulation using HFSS™.

Equations 3-5 show that the conductor losses are a function of the physical dimensions of the waveguide and the conduction losses contributed by sidewalls are independent of the substrate thickness. FIG. 6A plots a set of curves of losses per unit length at 12.45 GHz according to Equations 3-5 using a lossless dielectric with $\epsilon_r$=2.2, standard PCB board thickness as the b dimension and the conductivity of copper (5.8e7S/m) for all conductive surfaces. FIG. 6B shows the losses per unit length at 12.45 GHz simulated using HFSS™.

As can be seen from FIGS. 6A and 6B, even when the a dimension and waveguide thickness, b, are large, the conductor loss is comparable to the dielectric loss and cannot be ignored. Significant conductor loss reduction is achieved by using thicker substrates, as indicated by the dependence of the second term of Equation 3 on the waveguide thickness, b.

Moreover, it is obvious that there is a significant difference between the HFSS™ simulated results, shown in FIG. 6A, and the closed-form expressions calculated results, shown in FIG. 6B. The difference was expected due to the extra sidewall losses of the SIW structure. In a conventional metallic waveguide, the ratio between $R_{s1}$ and $R_{s2}$ is (or should be) the same.

From the loss analysis of the SIW, it is apparent that the minimum insertion loss of antenna array feed network is achieved by using thick, low-loss dielectric substrates. By carefully selecting the spacing and diameter of the posts, e.g., using values close to the 0.01 dB/m line in FIG. 4, the leakage loss is reduced to a level that is several orders of magnitude less than the dielectric loss and the conductor loss. In one embodiment, the post spacing is limited to values that are at least twice the diameter of the post in order to reduce the overall fabrication cost.

In one embodiment, a dielectric with a relative permittivity, $\epsilon_r$, of approximately 2.2 and a thickness of 125 mil (the maximum available standard thickness) provides approximately 0.6 dB/m conductor loss for a SIW with an $a_{eq}$ dimension of 12.8 mm. The dielectric loss tangent is less than 0.001, which still accounts for about 2.0 dB/m dielectric loss. The selected post diameter is approximately 1.25 mm and the post spacing is twice the post diameter, in order to avoid overloading the substrate with plated vias. For a SIW structure these dimensions, the leakage loss factor is approximately 0.01 dB/m, which is insignificant when compared to the conductor loss and the dielectric loss. Based on the results shown in FIGS. 5A and 5B, the overall loss is estimated to be in the range of 2.4 to 3 dB/m as a function of the waveguide width, a.

Figure 7:
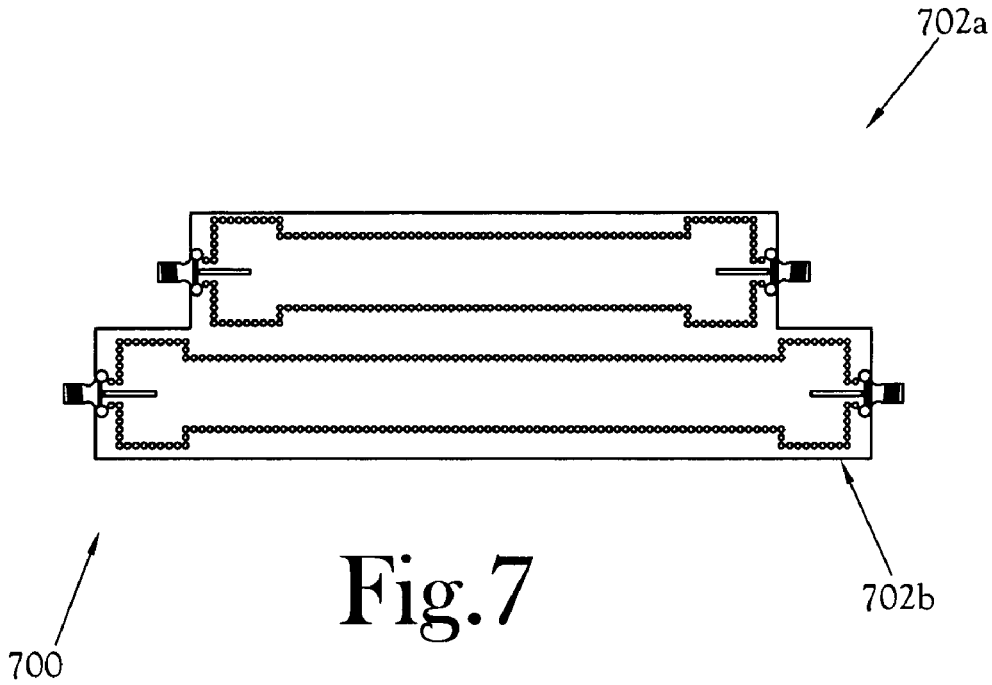
FIG. 7 illustrates of one embodiment of a test fixture having two linear SIWs with the same a dimension but a two-inch difference in lengths.

FIG. 7 illustrates a test fixture 700 used to experimentally evaluate the overall insertion loss per unit length of the SIW antenna and verify previous simulated results. The test fixture 700 includes two linear SIWs 702*a*, 702*b* fabricated on a single substrate of 125 mil thick RT/Duroid® 5880 high frequency laminate from Rogers Corporation having a relative permittivity, $\epsilon_r$, of 2.2 and dielectric loss tangent, tan δ, of 0.0009. Both of the SIWs 702*a*, 702*b* have waveguide widths of 13.5 mm, but the length of the second SIW 702*b* is greater than the length of the first SIW 702*a* by two inches.

Figure 8:
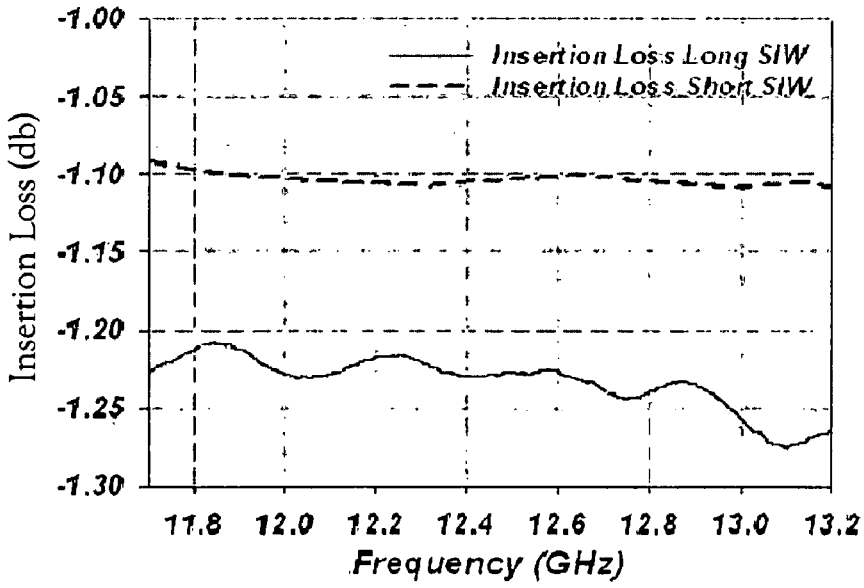
FIG. 8 graphs the insertion loss for the two SIW lines of FIG. 7.

FIG. 8 shows the results of back-to-back measurements of the differential insertion loss between the two SIWs 702*a*, 702*b*. Based on these measurements, the estimated insertion loss of the SIW is 0.07 dB/in, which translates to 2.75 dB/m. The measured insertion losses were higher than the predicted losses, which were calculated based on perfect copper conductivity. To account for variations such as imperfections and the lower metal surface conductivity of the plated vias, a loss factor is used in the conductor loss calculations. The loss factor may be established from measurement of a particular SIW or extrapolated from experimental results obtained from various SIWs.

The next element of the slotted SIW antenna array is a SIW-based feed network with adequate bandwidth and good phase balance. Waveguide "T"-junctions are a key component for the SIW antenna array feed network construction. Both serial and parallel feed networks are available. Parallel feed (i.e., the binary feed) generally requires more stages, hence real estate, but has proven to achieve the widest bandwidth for in-phase excitation.

Figure 9:
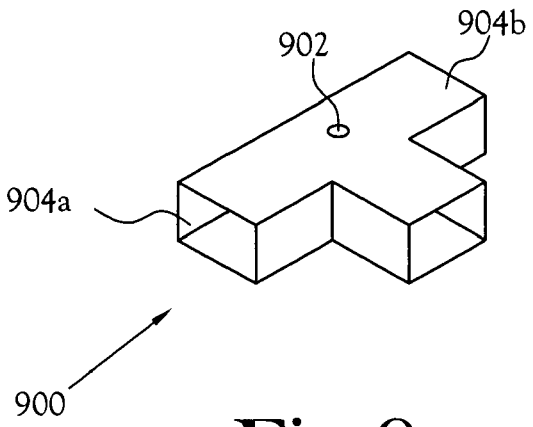
Fig.9 (PRIOR ART)
FIG. 9 illustrates a conventional metallic waveguide "T"-junction with an internal post to enhance the operating bandwidth.
Figure 10:
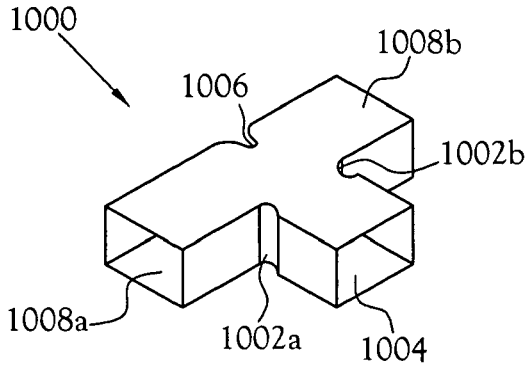
Fig.10 (PRIOR ART)
FIG. 10 illustrates a conventional metallic waveguide "T"-junction with wedges and diaphragms to split power while maintaining balanced phase.

In the field of conventional metallic waveguides, extensive study and development of different "T"-junction power dividers has been carried out. FIG. 9 illustrates a conventional metallic waveguide "T"-junction 900 having an isolated post 902 placed inside the "T"-junction 900 between the output ports 904*a*, 904*b* to enhance the operating bandwidth. (See J. Hirokawa, K. Sakural, M. Ando, and N. Goto, "An analysis of a waveguide T junction with an inductive post," *IEEE Trans. Microwave Theory and Tech.*, vol. MTT-39, pp. 563-566, March 1991). However, the manufacturing of an isolated post 902 inside the "T"-junction 900 is a fundamental difficulty for mass production, especially when the design is dimensionally sensitive. Previously, the present inventors developed a synthesis procedure for a power divider in a conventional metallic waveguide "T"-junction to achieve an arbitrary power split ratio while keeping a balanced phase between the output ports. (See Songnan Yang and Aly E. Fathy, "Synthesis of a Compound T junction for a Two-Way Splitter with Arbitrary Power Ratio," 2005 *IEEE MTTS Int. Symp. Dig.*, pp 985-988, June 2005). FIG. 10 illustrates a conventional metallic waveguide "T"-junction 1000 incorporating the power divider mentioned above. The power divider includes a pair of diaphragms 1002*a*, 1002*b* located in the input port 1004 to direct incoming waves toward a wedge 1006 located within the "T"-junction 1000 between the output ports 1008*a*, 1008*b*. Because the diaphragms 1002*a*, 1002*b* and the wedge 1006 are incorporated into the sidewalls and not separated from the "T"-junction body, fabrication of these structures, including cast fabrication, is relatively easy.

Figure 11:
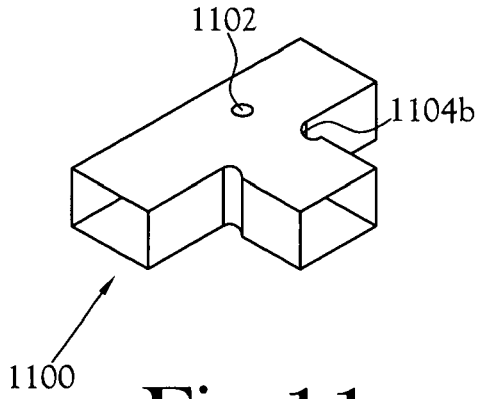
Fig.11 (PRIOR ART)
FIG. 11 illustrates of one embodiment of a conceptual metallic waveguide "T"-junction combining the internal post of FIG. 10 with the diaphragms of FIG. 10 for use with the equivalence concepts discussed herein.
Figure 12A:
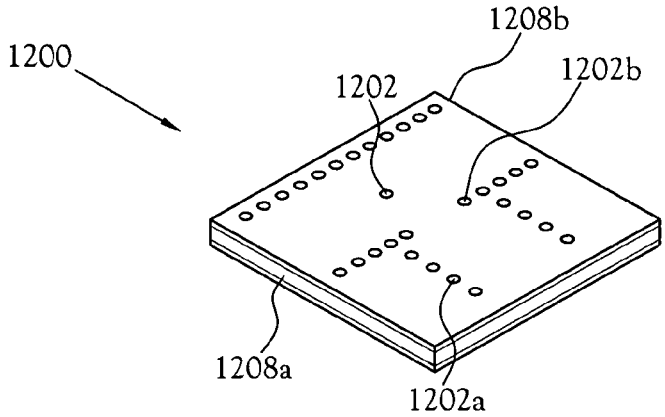
FIG. 12A is a perspective view of one embodiment of a translation of the conceptual metallic waveguide "T"-junction of FIG. 11 into a SIW "T"-junction using the equivalence concepts discussed herein.
Figure 12B:
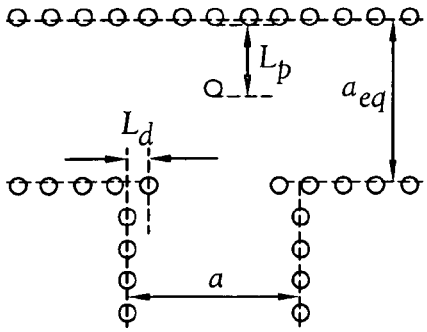
FIG. 12B is a top plan view illustrating the basic dimensional parameters of the SIW "T"-junction of FIG. 12B.

FIG. 11 illustrates the integration of the designs of FIGS. 9 and 10 in a metallic waveguide "T"-junction 1100 as conceived by the present inventors to serve as a the basis for an equivalent SIW "T"-junction. Because a SIW is defined by a plurality of plated vias in the dielectric substrate, inserting a matching post inside a "T"-junction does not make fabrication more difficult. Thus, the conceptual "T"-junction 1100 combines an isolated post 1102 and a pair of diaphragms 1104*a*, 1104*b* to achieve a "T"-junction 1100 with enhanced bandwidth and a power divider. FIG. 12A shows the conceptual metallic waveguide "T"-junction 1100 of FIG. 11 translated into an equivalent "T"-junction 1200 using the equivalence concepts developed by the present inventors. The equivalent "T"-junction 1200 includes a plated via 1202 located between the output ports 1208*a*, 1208*b* and a pair of posts 1202*a*, 1202*b* replace the diaphragms 1104*a*, 1104*b* in the input port 1206. Thus, the equivalent "T"-junction 1200 is suitable for fabrication in a SIW. FIG. 12B illustrates the dimensional parameters of the SIW "T"-junction 1200.

Figure 13:
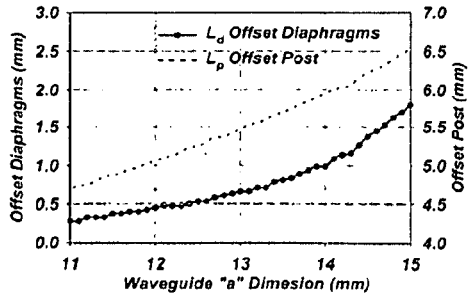
FIG. 13 is a design chart for the SIW "T"-junction dimensional parameters.

Using extensive HFSS™ numerical simulations, the present inventors have developed design charts for the SIW "T"-junction design parameters that are useful in designing the post-diaphragm configuration. As shown in FIG. 13, both the offset/distance of post in the junction from the common sidewall of two outputs, $L_p$, and the offset/indent of the vias forming the diaphragms from sidewalls of the input SIW, $L_d$, have been optimized to achieve a return loss better than −50 dB at the center frequency.

Figure 14A:
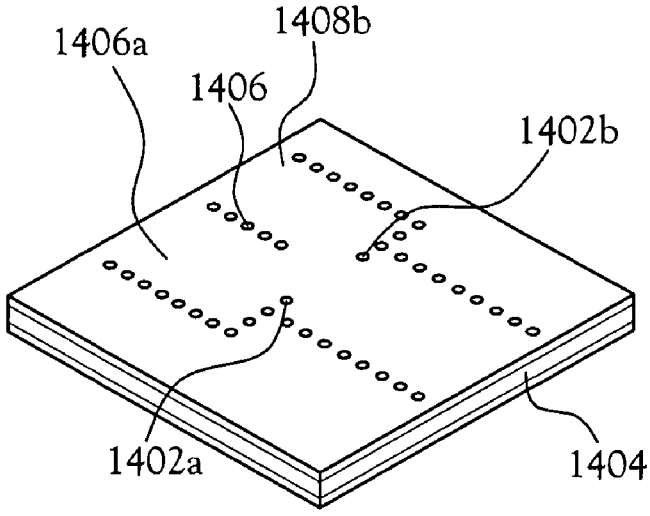
FIG. 14A is of one embodiment of a perspective view of a SIW "Y"-junction.
Figure 14B:
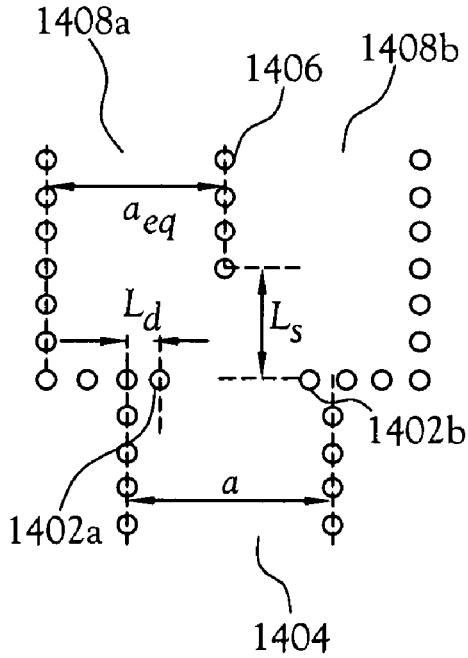
FIG. 14B is a top plan view illustrating the basic dimensional parameters of the SIW "Y"-junction of FIG. 14A.
Figure 15:
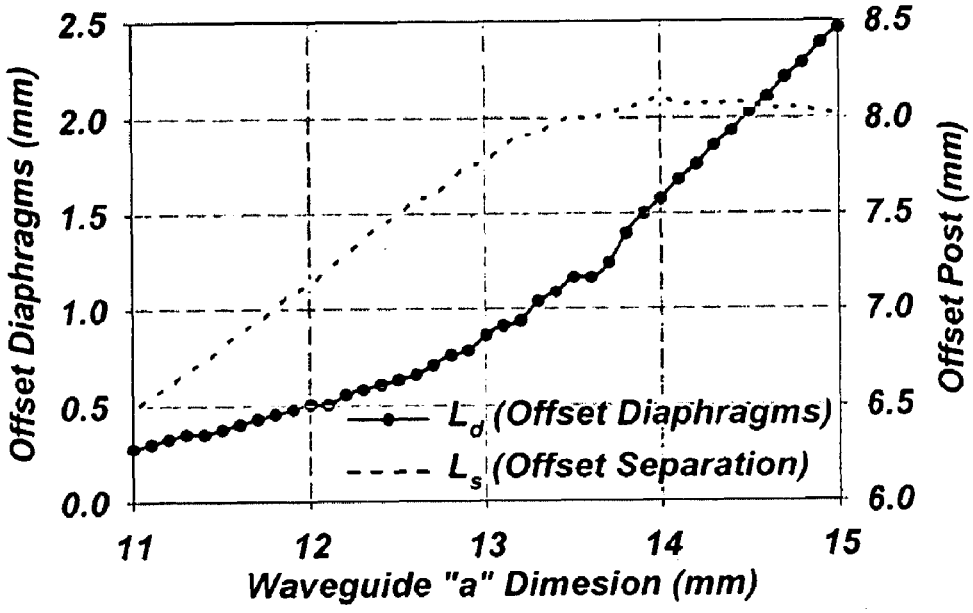
FIG. 15 is a design chart for the SIW "T"-junction dimensional parameters.

FIG. 14A illustrates a perspective view of a SIW "Y"-junction 1400, a special case of the "T"-junction. A "Y"-junction is typically used at the input of the binary feeding network. Like the SIW "T"-junction, the "Y"-junction 1400 is compensated by the introduction of diaphragms 1402*a*, 1402*b* at the input 1404 and by offsetting the common sidewall 1406 of the outputs 1408*a*, 1408*b*. FIG. 14B illustrates a top plan view of a SIW "Y" junction showing the basic dimensional parameters. FIG. 15 shows a set of design curves generated for the SIW "Y"-junction by applying the same method used with the SIW "T"-junction.

In one embodiment of the present invention discussed above, the feed guide a dimension is designed to minimize the insertion loss. Although increasing the a dimension beyond the previously selected value leads to further conductor loss reduction; the maximum width dimension is limited by the maximum allowable physical space to be occupied by the feed network. Further, in order to meet the reception requirements for US DBS signals, both the "T"-junction and the "Y"-junction provide a bandwidth of at least 500 MHz.

Figure 16:
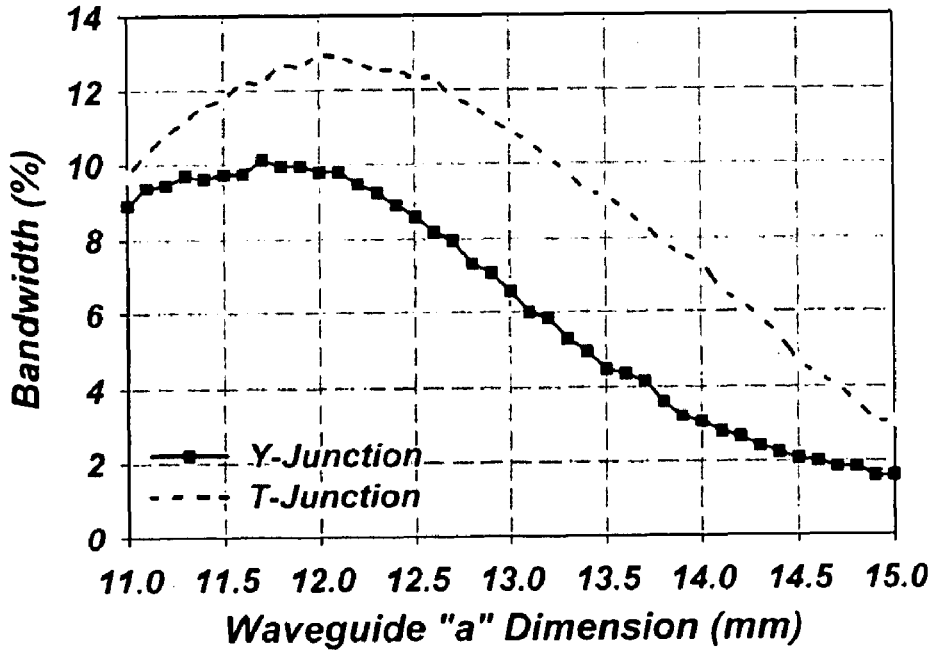
FIG. 16 is graph comparing the bandwidth of the SIW "T"-junction and the SIW "Y"-junction.

FIG. 16 graphs the simulated bandwidth of both the SIW "T"-junction and the SIW"Y"-junction as function of the a dimension for return loss less than −30 dB. Both structures provide a fairly wide operating bandwidth. When the SIW is narrow, the bandwidth peaks at 13% for the "T"-junction and at 10% for the "Y"-junction. Along the diaphragms offsets, the quality factor of the junction becomes higher and higher, so the bandwidth continues to drop as the width of SIW increases. However, for both of the junctions, it is very easy to achieve 500 MHz at 12.45 GHz (~4%) bandwidth. Therefore, in order to sufficiently minimize the feed network loss, one embodiment of the present invention utilizes an optimum value for the SIW a dimension of 14.2 mm.

Figure 17:
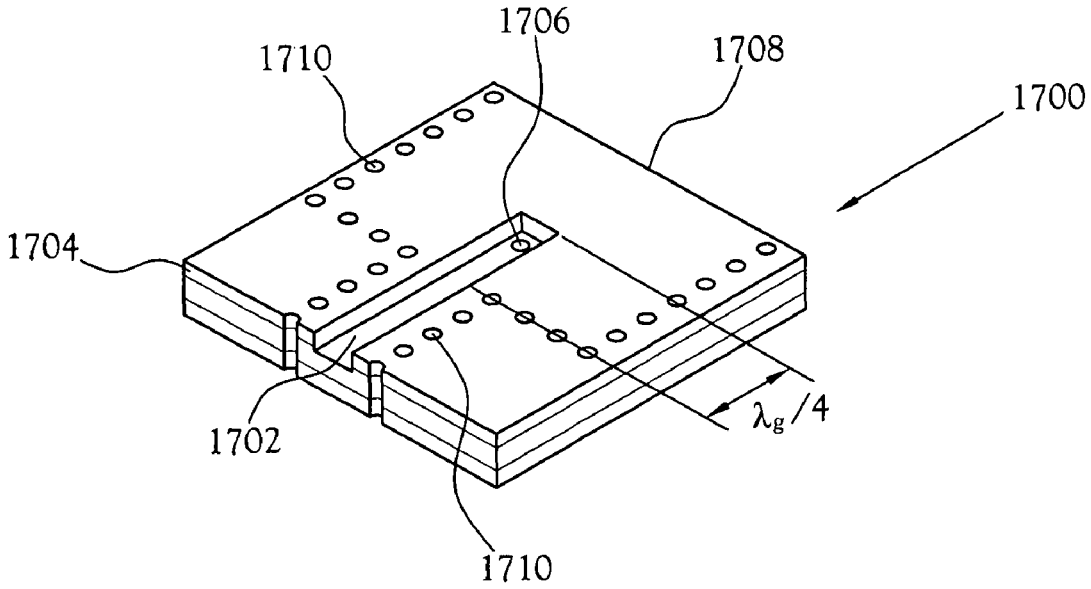
Fig.17 (PRIOR ART)
FIG. 17 is a perspective view of a transition between a grounded coplanar waveguide (GCPW) and a SIW according to the prior art.
Figure 18:
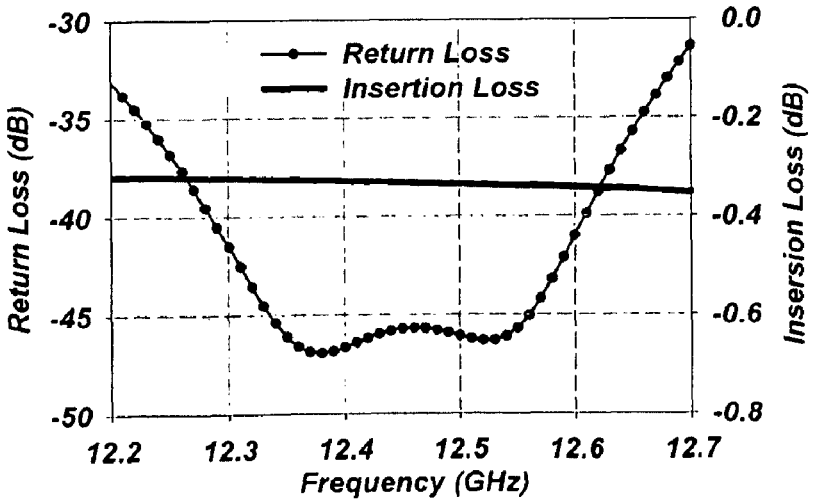
FIG. 18 graphs the simulated insertion loss and return loss resulting from back-to-back transitions using the prior art transition of FIG. 17.

FIG. 17 illustrates a conventional current probe transition 1700 from a grounded coplanar waveguide (GCPW) 1702 to the SIW 1706, which is the next element of the slotted SIW antenna array. The current probe transition 1700 is used to transform the transmission line from a waveguide to a planar structure that is easily integrated with active devices in a later stage. (See Dominic Deslandes and Ke Wu, "Analysis and Design of Current Probe Transition From Grounded Coplanar to Substrate Integrated Rectangular Waveguides," *IEEE Trans. Microwave Theory & Tech.*, vol. 53, no. 8, pp. 2487-2495, August 2005). The current probe transition 1700 includes a GCPW slot 1702 cut or etched through one layer of metal plating 1704. A plated via 1706 located in the SIW region 1708 operates as a current coupling probe. To insure full energy propagation in one direction, a back short for the current coupling probe 1706 is provided wherein the GCPW slot 1702 is terminated by an open circuit next to the current coupling probe 1706. In addition, the sidewall vias 1710 are strategically placed along the GCPW slot 1702 to cancel the parallel plate mode in the GCPW slot 1702 and to cut off the waveguide modes entering the GCPW slot 1702 from the SIW region 1708. In order to allow easy connection to coaxial connectors, a characteristic impedance of 50Ω is selected for both the GCPW and the SIW lines. In one embodiment, the slot width of the GCPW structure is the minimum width that can be manufactured, and the SIW has been widened in the junction area. FIG. 18 illustrates the simulated return loss and the simulated insertion loss of back-to-back transitions for the current probe transition 1700. From FIG. 18, it will be appreciated that the current probe transition 1700 provides suitable input transitions.

Figure 19:
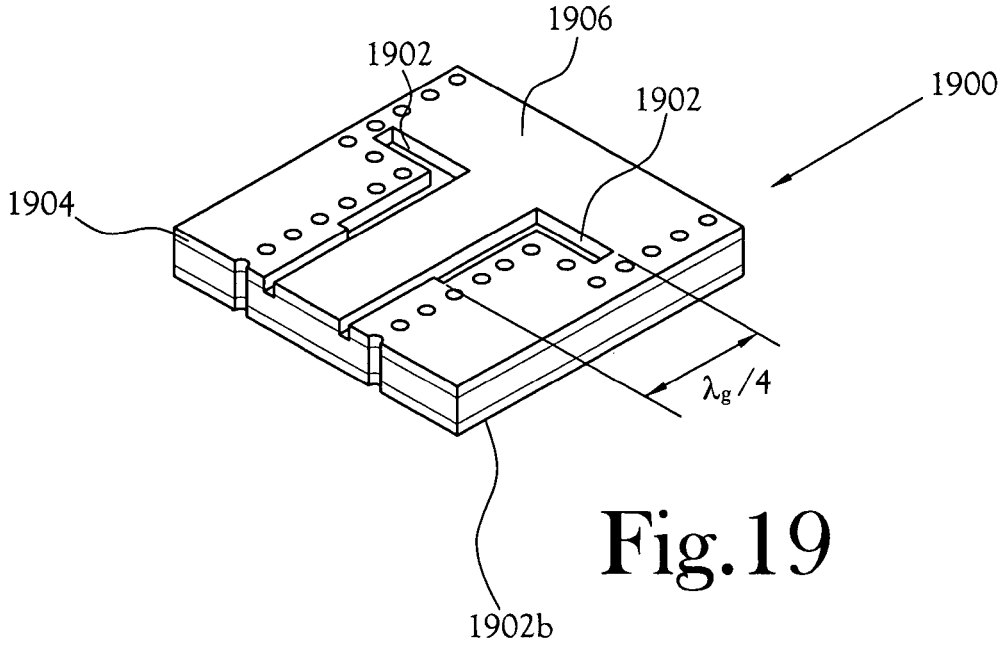
FIG. 19 is a perspective view of a wideband transition between a grounded coplanar waveguide (GCPW) and a SIW according to the present invention.

FIG. 19 shows a wideband transition 1900 between a GCPW and a SIW using an electric field coupling developed by the present inventors. Using a CGPW with a ground reduces the loss caused by the radiation of the transition structure. The wideband transition 1900 includes a pair of coupling slots 1902 etched or cut through one layer of metal plating 1904 of the SIW and placed next to the short circuit termination of the SIW region 1906. The coupling slots 1902 act like a magnetic dipole antenna with the electric field across the slots 1902 being strong at the center of the slots and weaker at the ends of the slots. The electric field distribution of the wideband transition 1900 matches the electric field distribution of the $TE_{10}$ mode in the SIW structure, hence a smooth transition is achieved.

Figure 20:
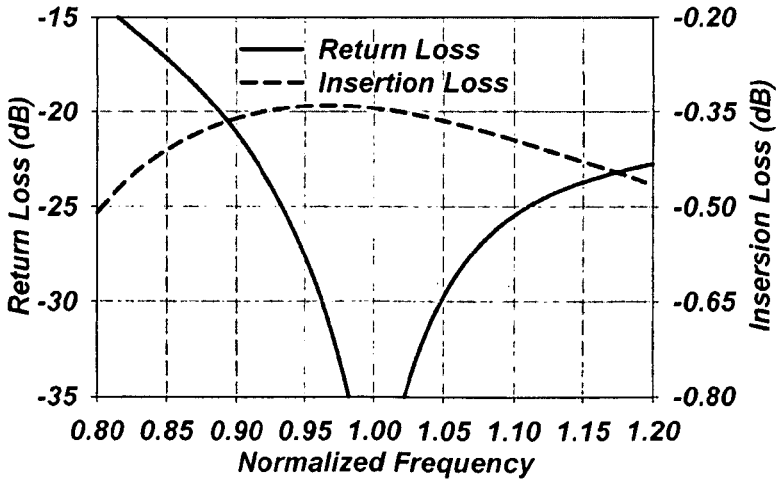
FIG. 20 graphs the simulated insertion loss and return loss resulting from back-to-back transitions using the wideband transition of FIG. 19.

FIG. 20 graphs the simulated insertion loss and return loss resulting from back-to-back transitions using the wideband transition of FIG. 19. A wider operating bandwidth is achieved (greater than 15% at −25 dB) compared to the operating bandwidth of the current probe transition 1700 (approximately 6% at −25 dB). Additionally, the corresponding insertion loss performance is also improved. The wideband transition 1900 does not require a 50Ω impedance for the SIW region because a quarter-wavelength impedance transformer is added in the CPWG region to convert the SIW characteristic impedance to the CPWG port impedance.

Figure 21:
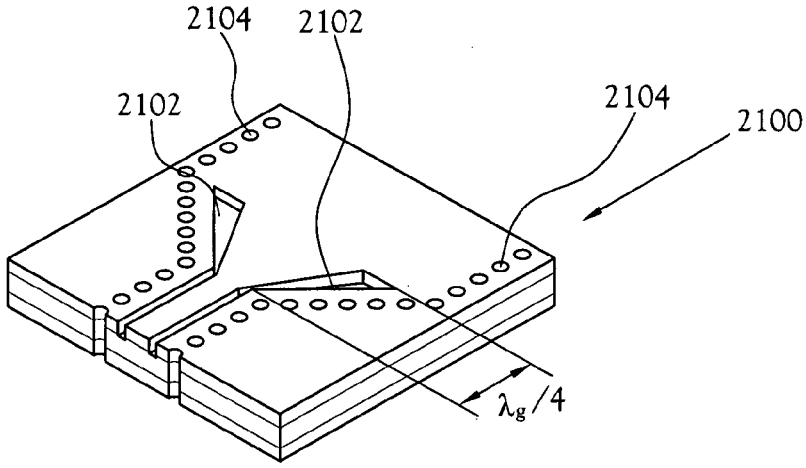
FIG. 21 is a perspective view of an ultra-wideband transition between a grounded coplanar waveguide (GCPW) and a SIW according to the present invention.

The impedance transformer used in the wideband transition 1900 limits its bandwidth. FIG. 21 shows an ultra wideband (UWB) transition 2100 between a GCPW and a SIW developed by the present inventors. By integrating a coupling slot and an impedance transformer into a single tapered coupling slot 2102, an even wider transition bandwidth is obtained. In the illustrated embodiment, the sidewalls 2104 of the SIW are tapered along the triangle shaped coupling slots 2102 such that the direction of the electric field on the coupling slot is always perpendicular to the SIW sidewalls to provide a smooth transition. The tapered coupling slots 2102 also serve as impedance transformers to transform any arbitrary impedance line in the SIW to the CPWG port impedance.

Figure 22:
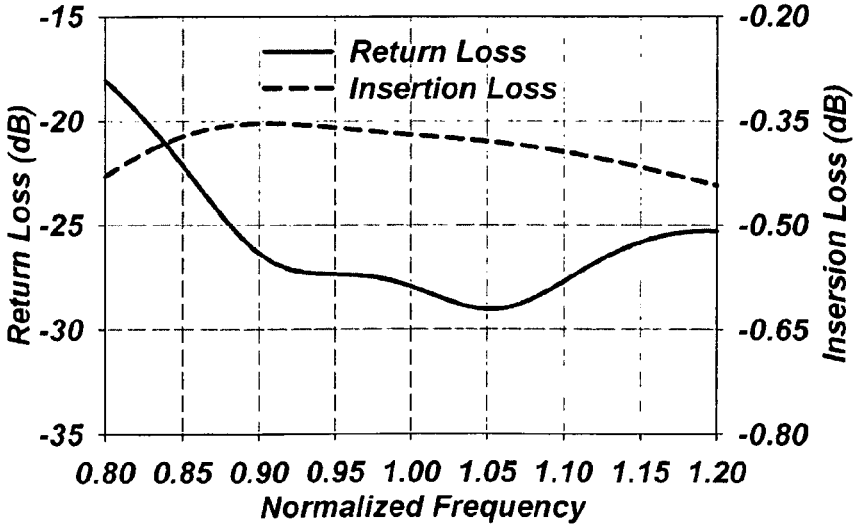
FIG. 22 graphs the simulated insertion loss and return loss resulting from back-to-back transitions using the ultra-wideband transition of FIG. 21.

FIG. 22 graphs the simulated insertion loss and return loss resulting from back-to-back transitions using the UWB transition of FIG. 21. The UWB transition 2100 provides more than 35% bandwidth at −25 dB return loss. The insertion loss is almost the same as the other two transition topologies but provides a much wider usable bandwidth making it an attractive choice to feed high efficiency UWB antenna arrays.

The final primary element of the slotted SIW antenna array is the "X"-slotted radiating SIWs creating circularly polarized beams. Cross, or "X"-shaped, slots in a radiating waveguide slot array are densely arranged on the broad wall of the waveguide in order to produce circular polarization. The traveling waves in these waveguides radiate (leak) at a main beam with a certain angle, which is a function of the electrical spacing between the slots along the radiating waveguide slot array. (See W. J. Getsinger, "Elliptically Polarized Leaky-Wave Array", *IRE Trans. Antennas and Propagation*, vol. 10, pp. 165-171, March 1962).

Figure 23:
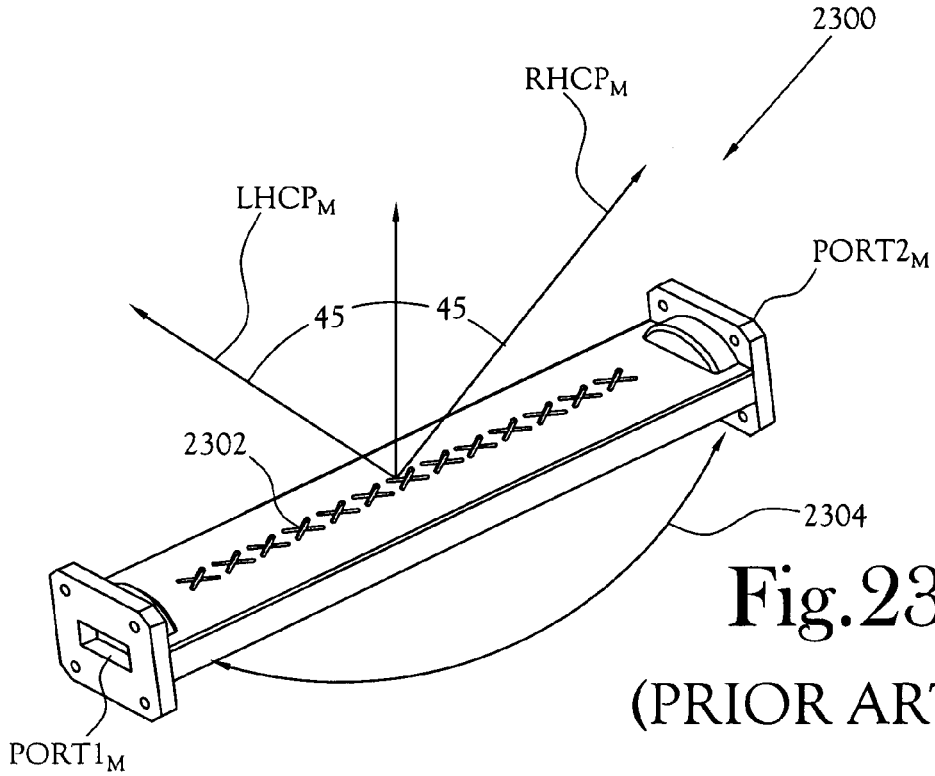
Fig.23 (PRIOR ART)
FIG. 23 illustrates a conventional single element metallic waveguide slot array.

The concept of dual hand circular polarization (DHCP) has been explored for previously-developed single element metallic waveguide slot array 2300, shown in FIG. 23. The metallic slot array 2300 has a first port PORT$\mathbf{1}_M$ and a second port PORT$\mathbf{2}_M$. When the cross-slots 2302 are excited by the dominant mode propagating in the metallic waveguide 2300 from the first port PORT$\mathbf{1}_M$ to the second port PORT$\mathbf{2}_M$, the slots radiate right-hand circular polarization (RHCP) at a tilt angle of 45° RHCP$_M$. When the same slots are excited by a mode traveling from the second port PORT$\mathbf{2}_M$ to the first port PORT$\mathbf{1}_M$, the slots radiate left-hand circular polarization (LHCP) at a tilt angle of −45° LHCP$_M$. Consequently, the first port PORT$\mathbf{1}_M$ and the second port PORT$\mathbf{2}_M$ correspond to RHCP and LHCP in +45° and −45°, respectively. However, a frequency beam squint is expected over the frequency range of 12.2 to 12.7 GHz.

Figure 24:
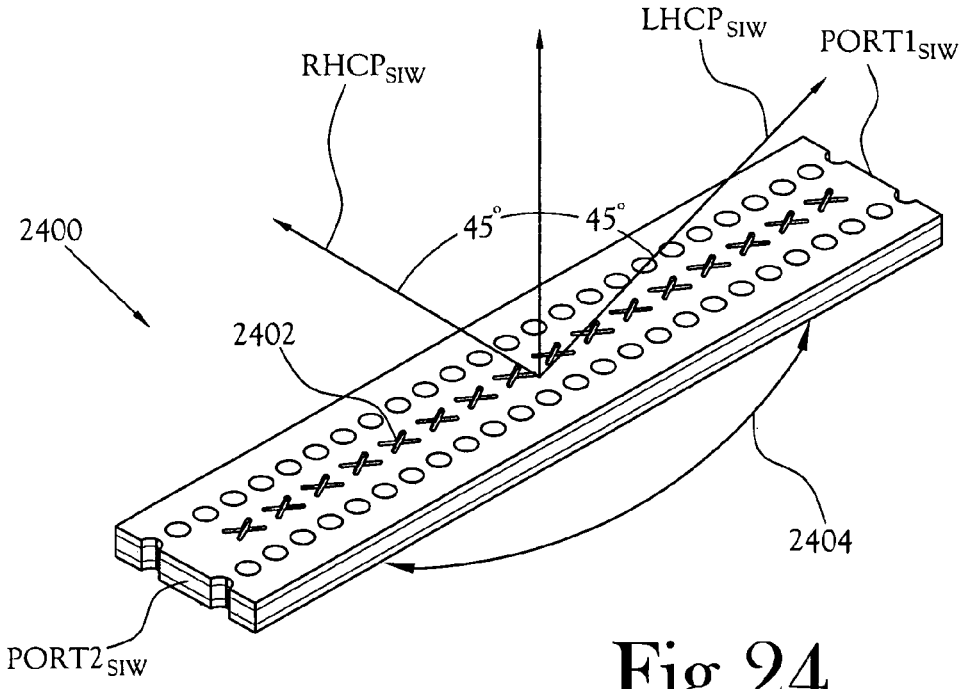
FIG. 24 illustrates one embodiment of a single element SIW slot array according to the present invention.
Figure 25A:
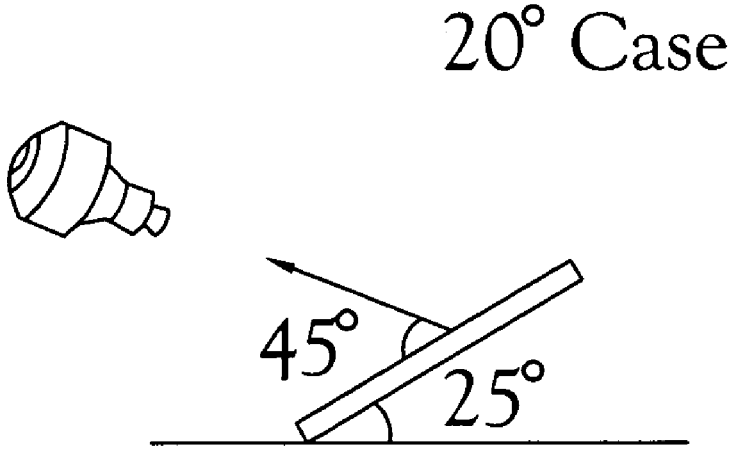
FIG. 25A illustrates the mechanical steering range of a leaky-wave slot-array antenna with 45° off broadside beam for a 20° case.
Figure 25B:
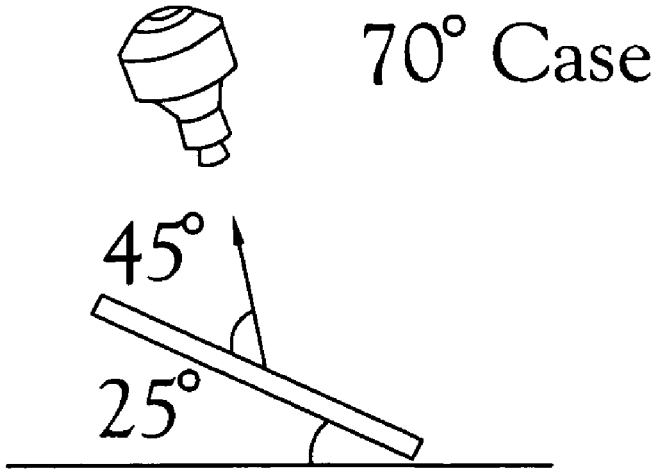
FIG. 25B illustrates the mechanical steering range of a leaky-wave slot-array antenna with 45° off broadside beam for a 70° case.

FIG. 24 is a perspective view of a single element SIW slot array 2400. In one embodiment, the SIW used for the single element has an a dimension of 14.2 mm and a substrate thickness, b, of 3.175 mm. As with the single element metallic slot array 2000, the single element SIW slot array 2400 includes a number of densely-spaced cross-slots 2408. In the illustrated embodiment, the single element SIW slot array 2400 includes 12 cross-slots, which are etched on the top plate of the SIW and are used to obtain circular polarization. When the cross-slots are excited by a mode propagating from the first port PORT$\mathbf{1}_{SIW}$ to the second port PORT$\mathbf{2}_{SIW}$, the slots radiate left-hand circular polarization with a tilt of 45° LHCP. When the same slots are excited by a mode traveling from the second port PORT$\mathbf{2}_{SIW}$ to the first port PORT$\mathbf{1}_{SIW}$, right-hand circular polarization is generated with a tilt angle of −45° RHCP$_{SIW}$. In one embodiment of the present invention optimized for DBS reception in the US, the electrical spacing of the cross-slots is selected to produce a 45° beam-tilt angle, which lowers the physical steering requirements in the elevation plane from 20° to 70° above horizon to only ±25° degrees from its horizontal position. FIGS. 25A and 25B illustrate the mechanical elevation steering range for the 20° case and for the 70° case when using a 45° beam.

While both the single element metallic slot array 2300 and the single element SIW slot array 2400 are designed to have the same main beam tilt angle, the directions of their main beams are opposite due to the dielectric loading. Inside the air-filled metallic waveguide 2300, a wave travels faster than the speed of light, while a wave in the dielectrically-loaded waveguide travels slower. Accordingly, the single element metallic slot array 2300 produces a beam pointing forward in the direction of wave travel, as shown in FIG. 20. Conversely, the single element SIW slot array 2400 radiates a beam pointing backward with respect to the direction of wave travel.

It should be noted that it is not possible to provide simultaneous dual polarization reception with either the single element metallic slot array 2300 or the single element SIW slot array 2400. However, two circularly polarized beams received from the same satellite are individually addressable by mechanically rotating the whole antenna 180° in azimuth.

Figure 26:
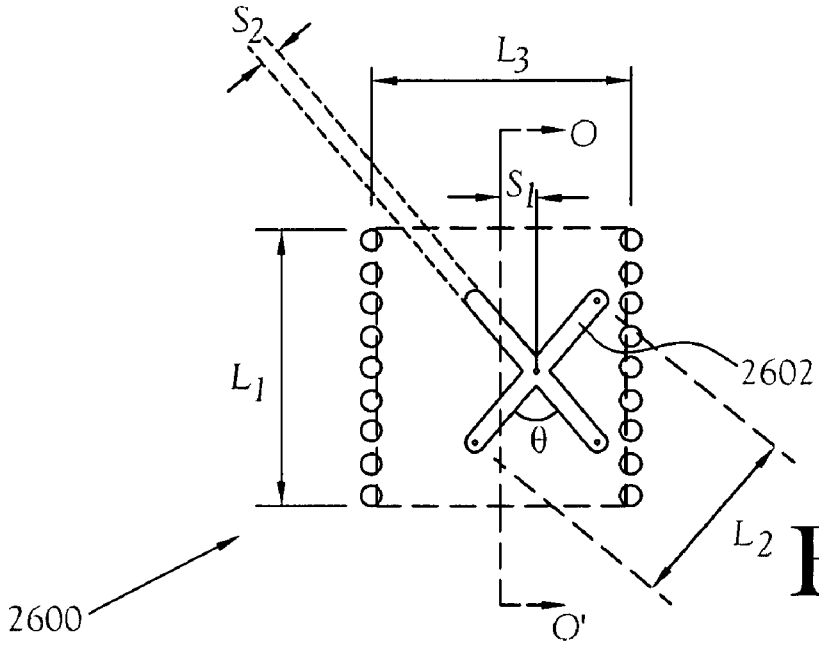
FIG. 26 is a top plan view of the basic dimensions of a single unit element cell from a SIW according to the present invention.

FIG. 26 looks at the single element SIW slot array design in greater detail, focusing on a single cell 2600 of the slot array. In one embodiment of the present invention, the design parameters of the cell 2600 are chosen to minimize the transmission between the two ports, maximize the gain of the main lobe, and maintain a good axial ratio at 45° degrees. In the illustrated embodiment, consistent with these objectives, the total length, $L_1$, of the cell 2600 is 11.18 mm. The offset, $S_1$, of the center of the cross-slot 2602 from the centerline of the waveguide broadside OO' is 2.29 mm. The slot width of each leg, $S_2$, of the cross-slot 2602 is 1.27 mm. The slot length of each leg, $L_2$, of the cross-slot 2602 is 9.65 mm. The angle, θ, between the legs of the cross-slot is 75°.

Figure 27:
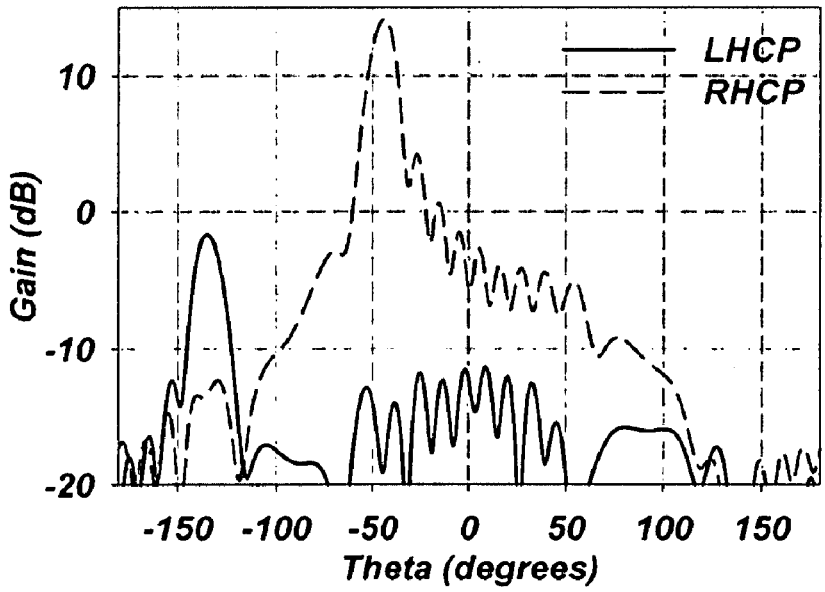
FIG. 27 graphs the predicted single element SIW slot array gain for both left hand circular polarization (LHCP) and right hand circular polarization (RHCP)

FIG. 27 illustrates the predicted gain for both LHCP and RHCP in a single element SIW slot array using the design parameters described above. As can be seen in FIG. 27, single element SIW slot array has an excellent axial ratio at the peak of RHCP radiation, which occurs approximately 45° off broadside.

Figure 28:
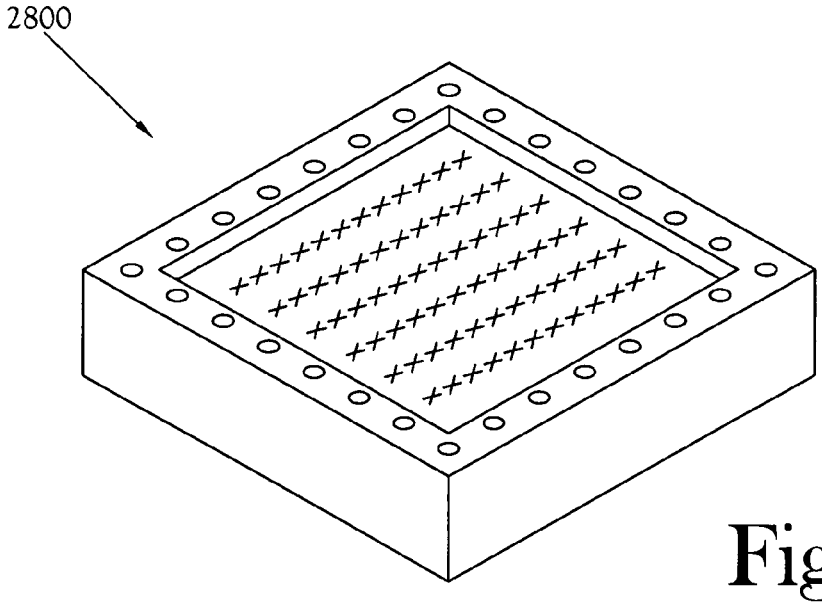
Fig.28 (PRIOR ART)
FIG. 28 is a perspective view of a conventional 12×6 metallic waveguide slot sub-array.

By combining the single element slot arrays, waveguide slot sub-arrays are produced. FIG. 28 illustrates a perspective view of a 12×6 metallic waveguide slot sub-array 2800. The 12×6 metallic waveguide slot sub-array 2800 includes the equivalent of six side-by-side single-element slot arrays, each with 12 machined cross-slots. Production of the 12×6 metallic waveguide slot sub-array 2800 requires CNC machining and high precision manufacturing. The result is a waveguide with a very high production cost. With regard to size, the 12×6 metallic waveguide slot sub-array 2800 requires different layers for the feeding network and the feed height exceeds 0.75 inch for two-layer feeding networks. For a WR62 waveguide, the typical inside dimensions are 0.622 inch by 0.311 inch and the typical outside dimensions are 0.702 inch by 0.391 inch. Thus, the 12×6 metallic waveguide slot array 2800 is expensive, bulky, and heavy. However, the losses in the WR62 12×6 metallic waveguide slot with a 0.280-inch reduced height waveguide are less than 0.025 dBi.

Figure 29:
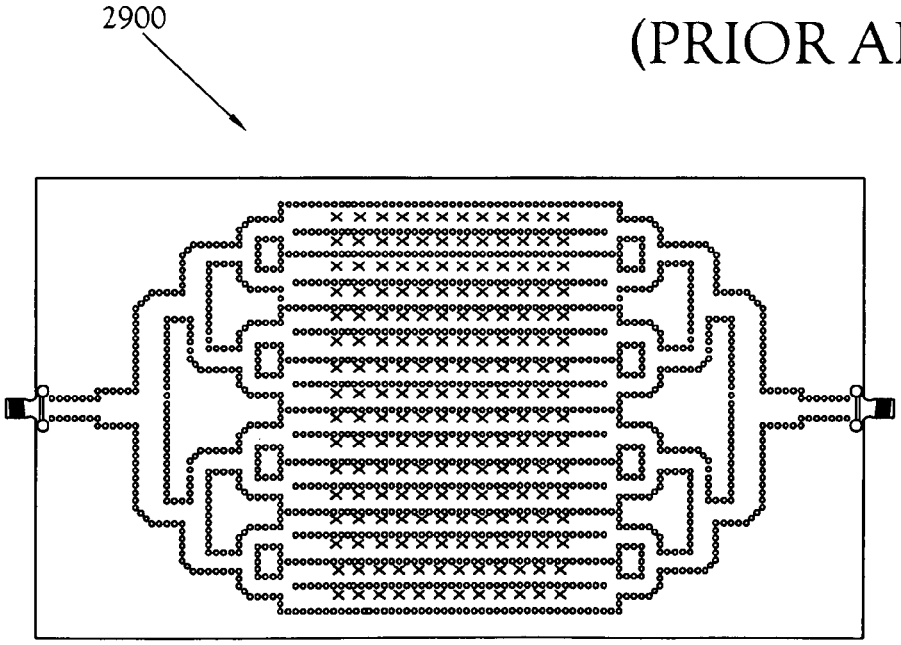
FIG. 29 is a top plan view of one embodiment of a 12×16 SIW slot sub-array according to the present invention.

FIG. 29 illustrates a top plan view of one embodiment of a 12×16 SIW slot sub-array29 2900 according to the present invention. The 12×16 SIW slot sub-array29 2900 includes 16 radiating waveguides, each with 12 cross-slots, and a 1-to-16 binary feed network, defined on a single substrate. Manufacturing of the SIW is accomplished using conventional printed circuit board (PCB) technology. The radiating slot elements are defined using chemical photo-etching process and are accurate to within ±0.001 inch. The reduced-height waveguide sidewalls are emulated using metalized vias. The 12×16 SIW slot sub-array29 2900 feeds easily integrated using coplanar structures and has a feed height of less than 0.25 inch for two-layer feeding networks. For a 12×16 SIW slot sub-array with a 0.125 inch thick RT/Duroid® 5880 substrate, the losses are less than 0.07 dB/inch. However, the 12×16 SIW slot sub-array29 2900 is lighter and has a lower profile than the 12×6 metallic waveguide slot sub-array 2800.

Figure 30:
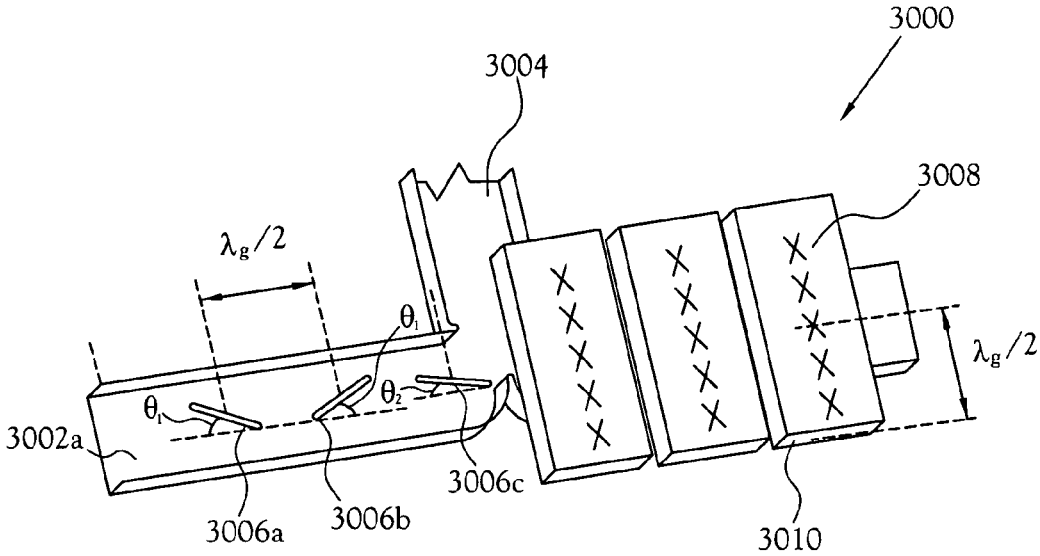
Fig.30 (PRIOR ART)
FIG. 30 is a perspective view of a conventional two-layer metallic waveguide feeding network partially sectioned to show underlying and internal components.

FIG. 30 illustrates a two-layer metallic waveguide feeding network 3000, with the top surface of the bottom later removed for visibility. The two-layer metallic waveguide feeding network 3000 has ports 3002*a*, 3002*b*, a port 3004 to the next combining stage, a series of coupling slots 3006*a*, 3006*b*, 3006*c* spaced apart at a distance of $\lambda_g/2$ on center and having angles of $\theta_1$ and $\theta_2$ on the first layer. A second layer of radiating waveguides 3008 with short circuits 3010 completes the two-layer metallic waveguide feeding network 3000.

Figure 31:
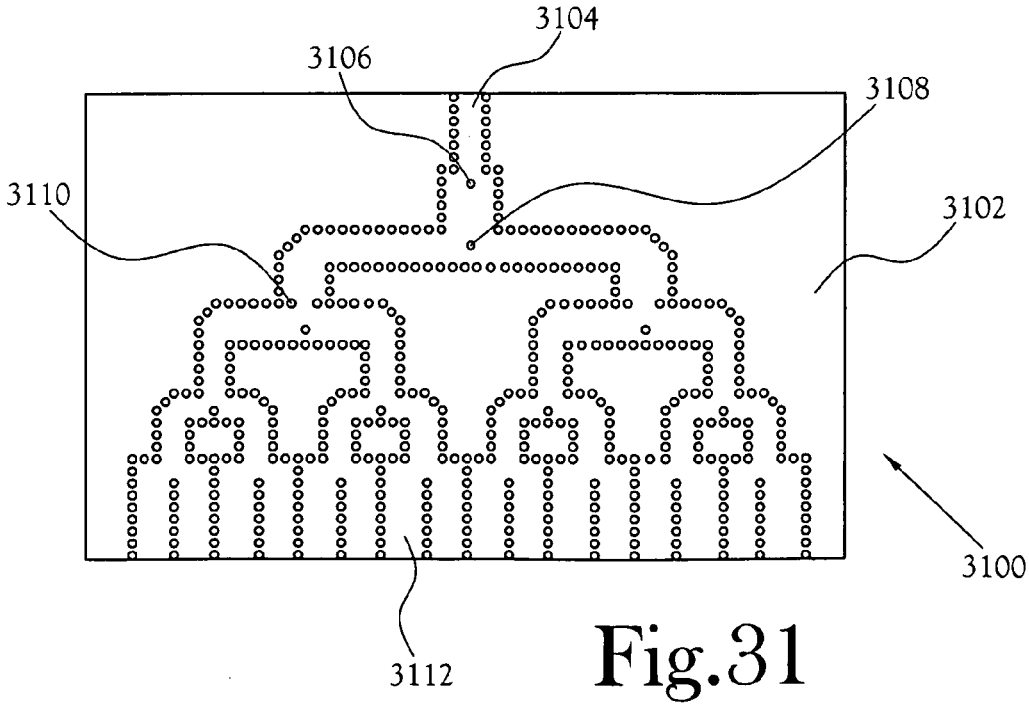
FIG. 31 is a top plan view of one embodiment of a SIW planar feeding network according to the present invention.

FIG. 31 illustrates a 1-to-16 binary feed network 3100 based on the SIW "T"- and "Y"-junction synthesis procedure developed by the present inventors. The 1-to-16 binary feed network 3100 is built on a substrate 3102 and has a single input 3104 and 16 outputs 3112. The 1-to-16 binary feed network 3100 includes a coaxial line to SIW transition through GCPW at the input and output ports. Also called out are the input coupling 3106, the matching posts 3108, and the matching diaphragms 3110 of the 1-to-16 binary feed network 3100.

Figure 32:
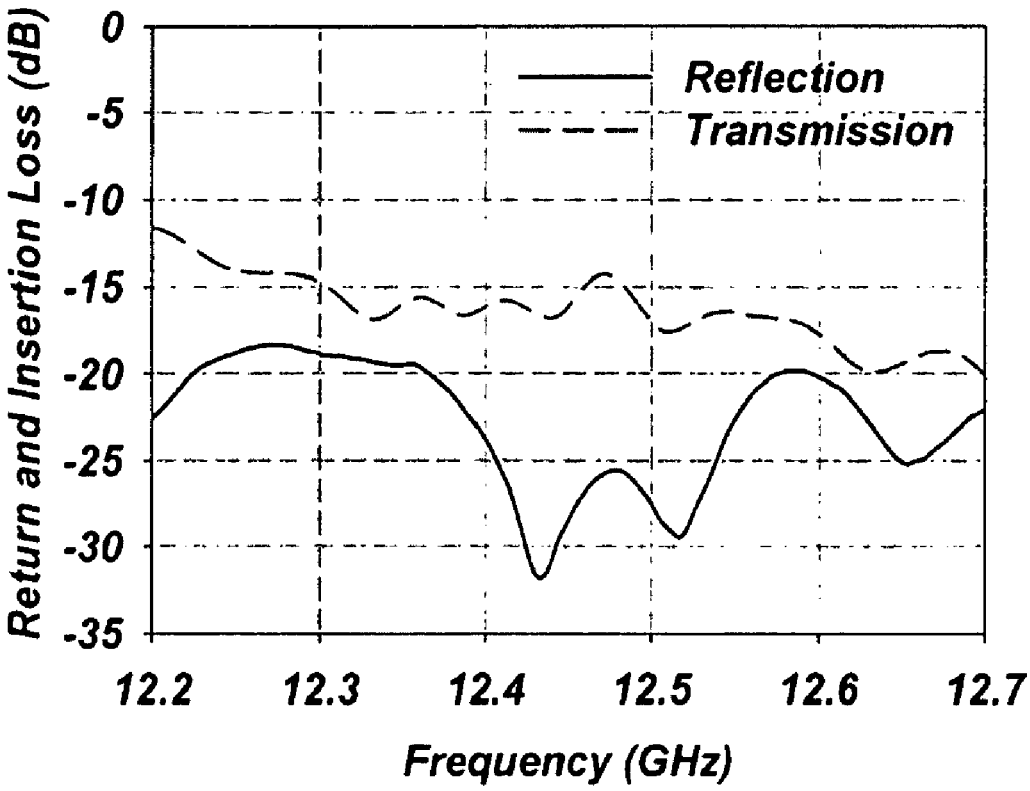
FIG. 32 graphs the measured insertion loss and return loss in the 12×16 SIW slot sub-array of FIG. 29.

The present inventors performed extensive S-parameter evaluation of the 12×16 sub-array 2900 using an HP8510C network analyzer. FIG. 32 shows the measured return and transmission loss of the SIW. The measured return loss is better than −18 dB, and the transmission (termination) loss is less than −15 dB. The −20 dB bandwidth of the sub-array is relatively narrow, which is due to the narrow band performance of SIW "T"-junction and the SIW "Y"-junction at the selected SIW width.

Figure 33A:
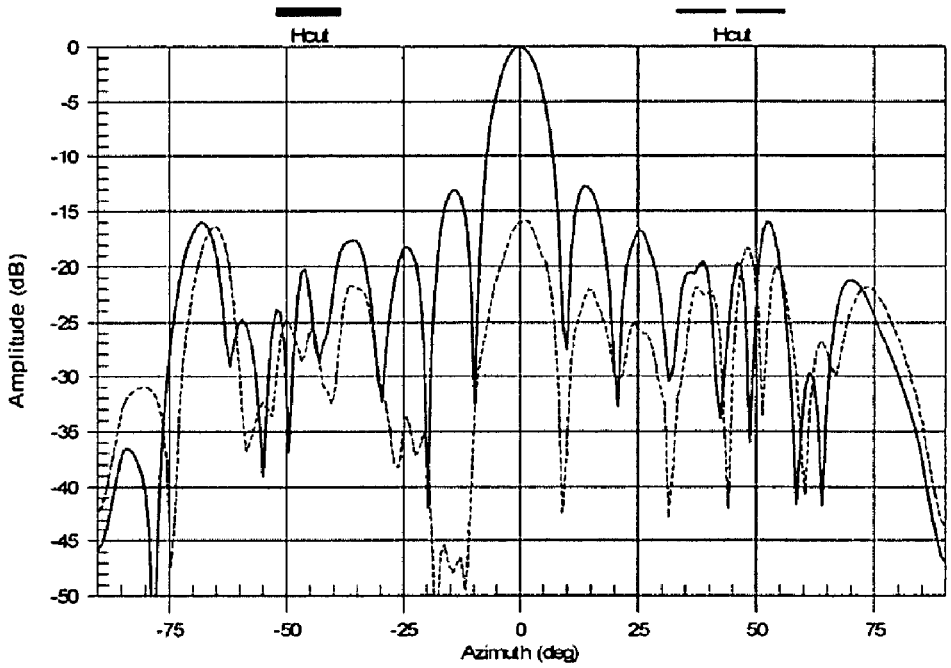
FIG. 33A is an azimuth cut the measured radiation patterns of the 12×16 SIW slot sub-array of FIG. 26 at 12.2 Ghz.
Figure 33B:
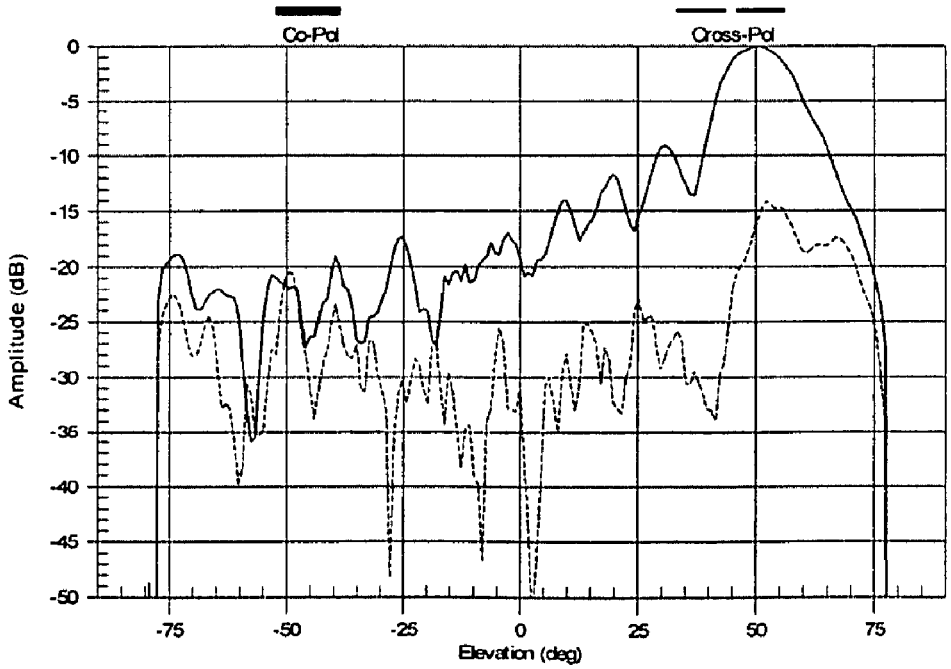
FIG. 33B is an elevation cut of the measured radiation patterns of the 12×16 SIW slot sub-array of FIG. 25 at 12.2 Ghz.
Figure 34A:
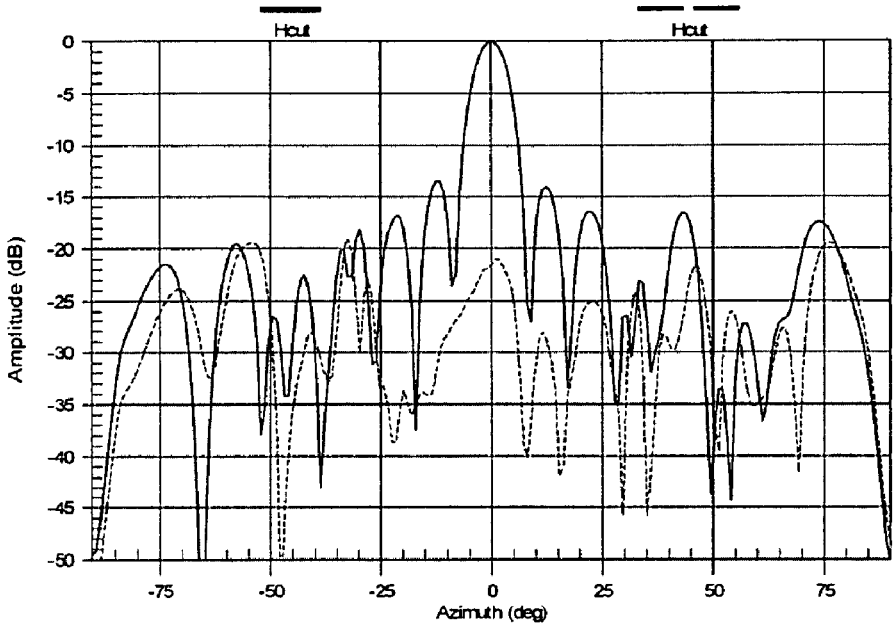
FIG. 34A is an azimuth cut the measured radiation patterns of the 12×16 SIW slot sub-array of FIG. 25 at 12.45 Ghz.
Figure 34B:
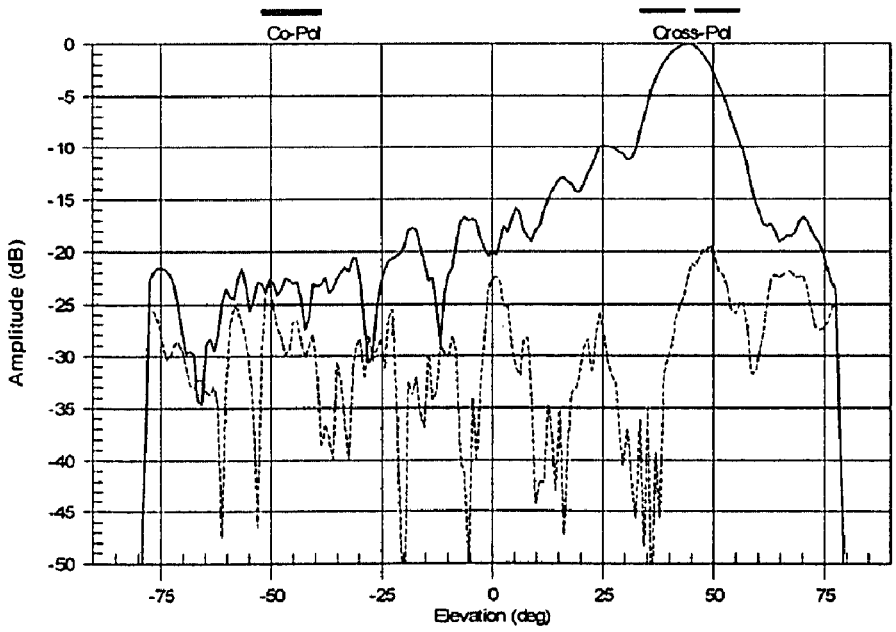
FIG. 34B is an elevation cut of the measured radiation patterns of the 12×16 SIW slot sub-array of FIG. 25 at 12.45 Ghz.
Figure 35A:
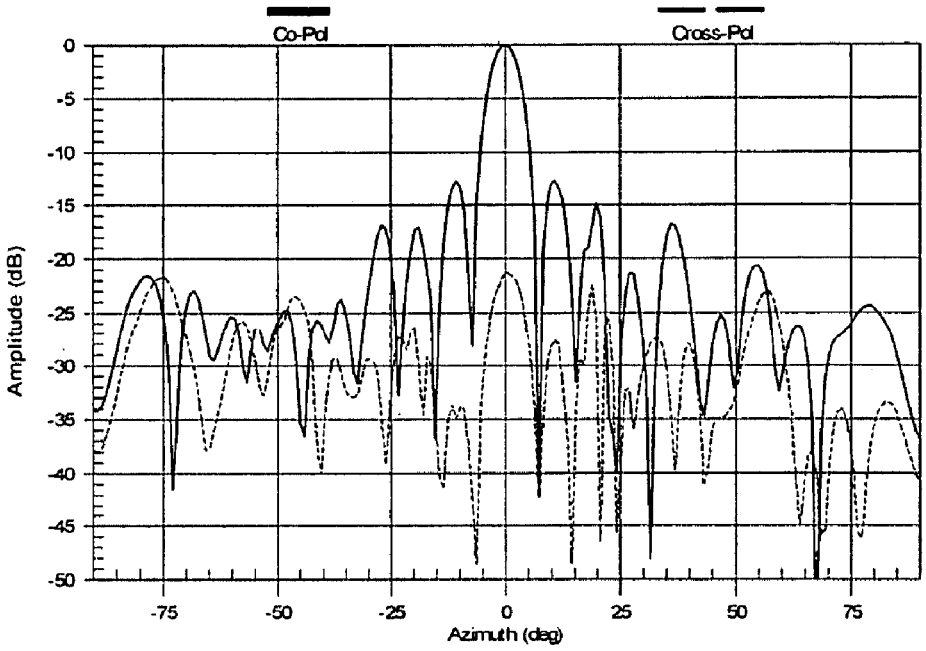
FIG. 35A is an azimuth cut of the measured radiation patterns of the 12×16 SIW slot sub-array of FIG. 25 at 12.7 Ghz.
Figure 35B:
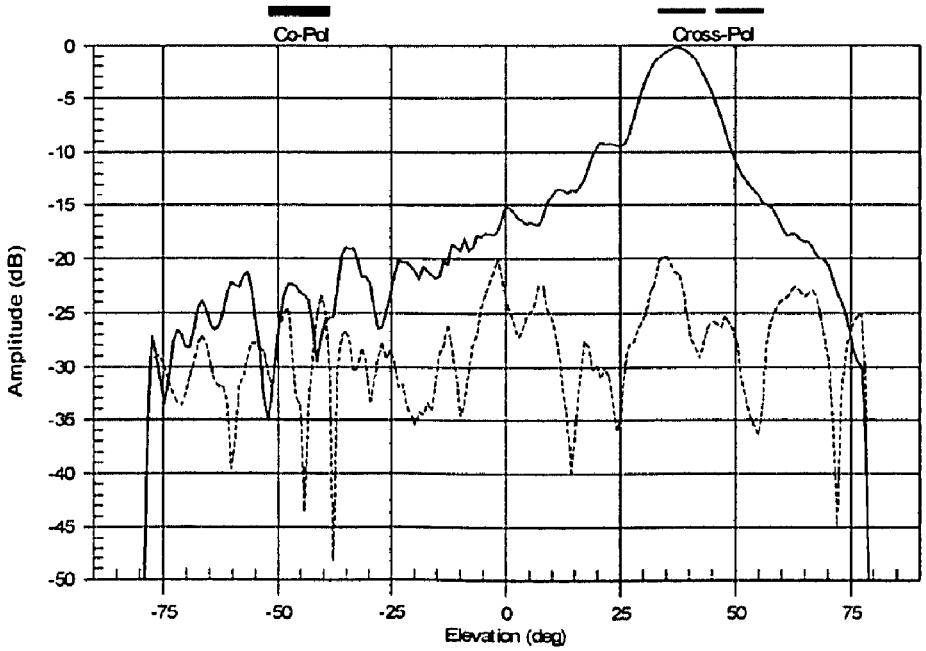
FIG. 35B is an elevation cut of the measured radiation patterns of the 12×16 SIW slot sub-array of FIG. 25 at 12.7 Ghz.
Figure 36:
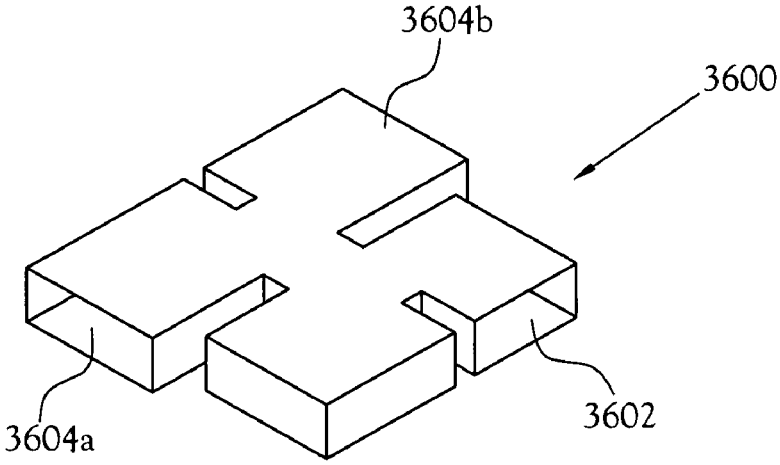
Fig.36 (PRIOR ART)
FIG. 36 illustrates a perspective view of a conventional compact metallic waveguide "T"-junction.

The radiation patterns of the 12×16 SIW sub-array 2900 were evaluated using both far-field and near-field measurement setups. (See S. Suleiman, S. Yang and A. E. Fathy, "Evaluation of a Ku Band Slotted Array Antenna Using Planar Near-Field Measurements," 2006 *IEEE AP-S Int. Symposium on Antennas and Propagation*, Albuquerque, N.Mex., USA. July 13-17). FIG. 33A illustrates the azimuth cut and FIG. 33B illustrates the elevation cut for 12.2 GHz. FIG. 34A illustrates the azimuth cut and FIG. 34B illustrates the elevation cut for 12.45 GHz. FIG. 35A illustrates the azimuth cut and FIG. 35B illustrates the elevation cut for 12.7 GHz. The measured radiation patterns were close to the simulated results over the range of 12.2 GHz to 12.7 GHz. Further, a gain of over 24.7 dBi gain was measured, which is equivalent to over 65% efficiency. Finally, the measured cross polarization levels were always better than 20 dB down from the peak of the main beam, which indicates a good axial ratio.

As shown in the measured radiation patterns of FIGS. 33A-35B the beam points exactly to 45° at the center frequency; however, the beam has a pronounced frequency dependent beam squint as the main beam moves between 51° from horizon at f=12.7 GHz and 39° from horizon at f=12.2 GHz. This beam squint is easily corrected by introducing a look-up table in the tracking system. The antenna tilt-angle is then adjusted based on the channel number selected.

This particular SIW slot sub-array structure is optimized for low losses. Although the efficiency of the SIW sub-array is slightly lower than that for the metallic sub-array version because of the losses introduced by the dielectric substrate material, the overall loss of the SIW sub-array is relatively small. Further, the smaller size of the SIW sub-array allows more radiating waveguides to be used when compared to a metallic sub-array of similar size. Thus, despite reduced efficiency, the SIW sub-array provides acceptable performance due to the greater number of radiating waveguides. One skilled in the art will appreciate that a SIW slot sub-array may be optimized to meet other objectives without departing from the scope and spirit of the present invention.

Figure 37:
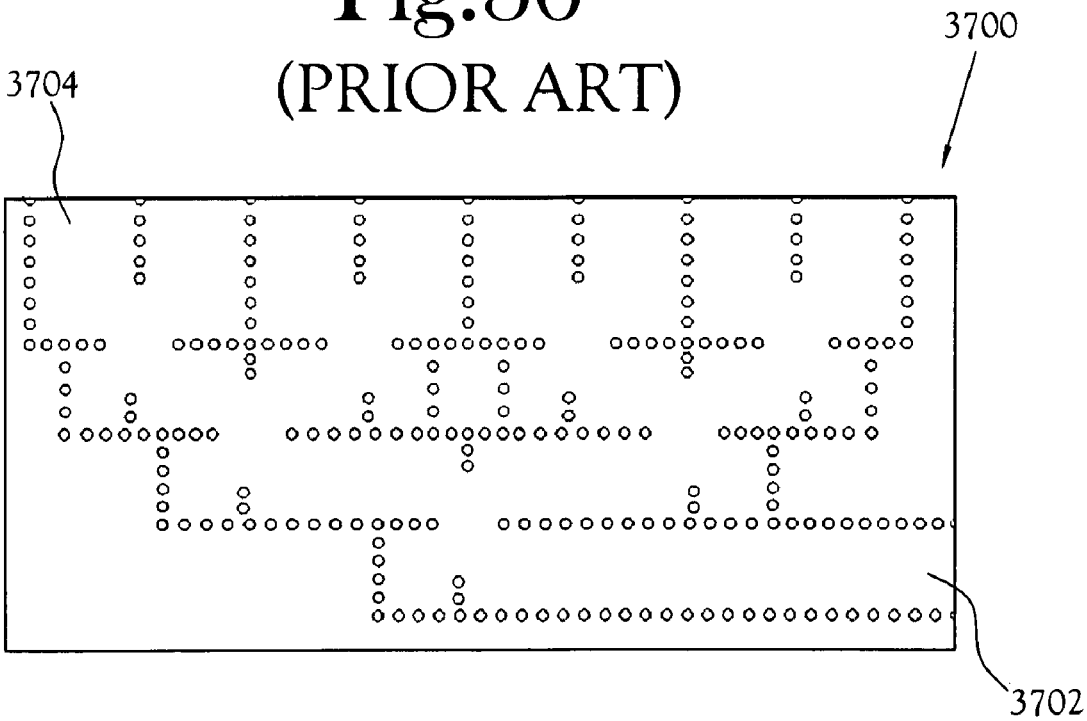
FIG. 37 illustrates a top plan view of a SIW 1-to-8 binary power divider structure according to the present invention.
Figure 38A:
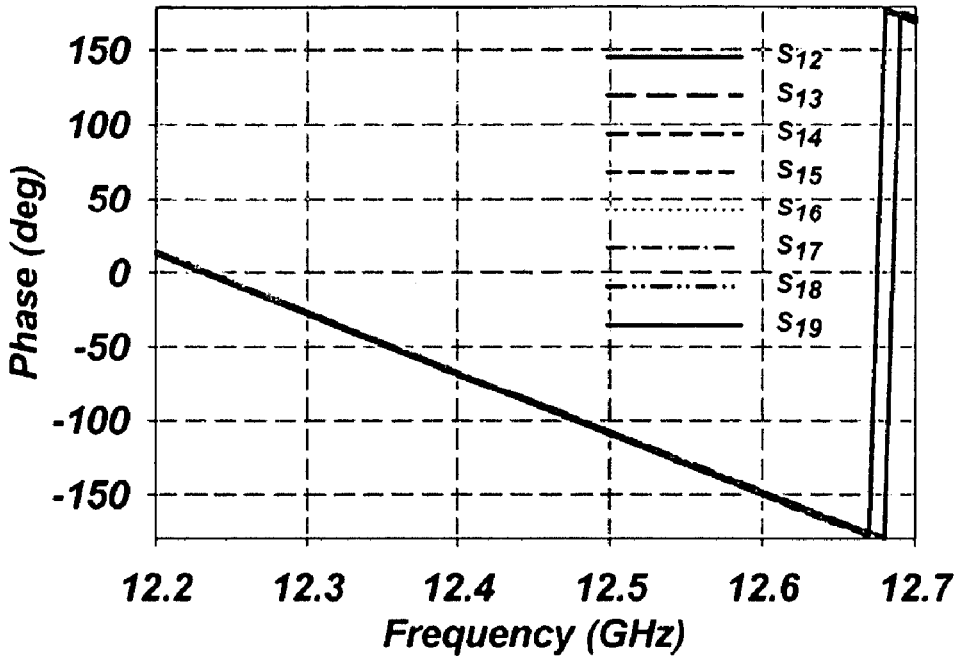
FIG. 38A graphs the simulated amplitude of the SIW 1-to-8 binary power divider of FIG. 34.
Figure 38B:
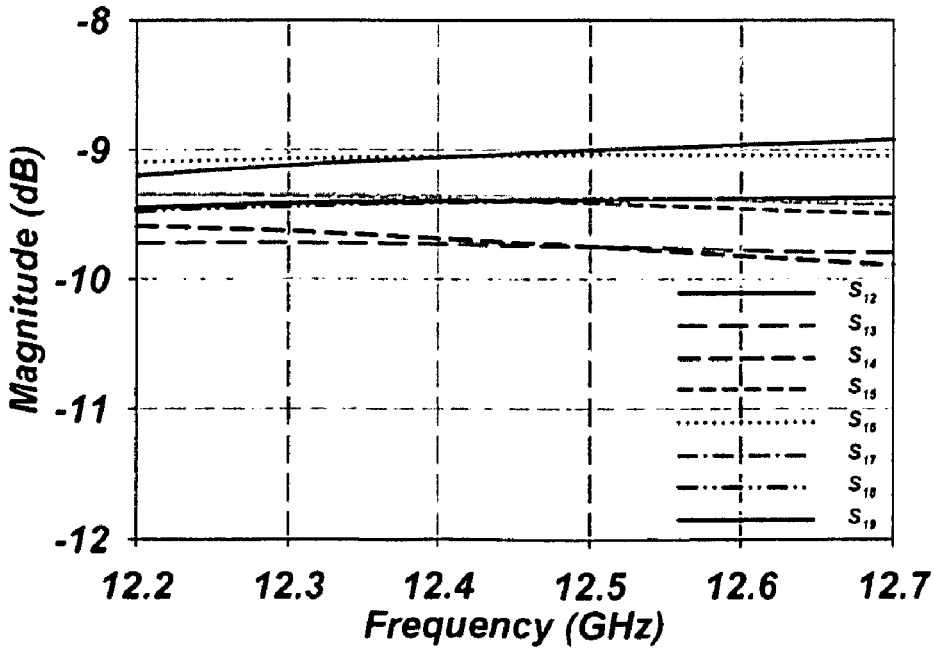
FIG. 38B graphs the simulated phase balance of the SIW 1-to-8 binary power divider of FIG. 37.

To implement a SIW full-array antenna, a binary feed network is used. A binary feed network achieves excellent match, bandwidth, and output phase balance. To facilitate implementation and minimize the size of feed network, compact waveguide "T"-junctions, such as the one illustrated in FIG. 33, and π-junctions have been "translated" into SIW. (See T. Takahashi, J. Hirokawa, M, Ando and N, Goto, "A single-layer power divider for a slotted waveguide array using π-junction with an inductive wall," *IEICE Trans. Commun.*, vol. E79-B, no. 1, pp. 57-62, January 1996; and K. Fukazawa, J. Hirokawa, M, Ando and N, Goto, "Two-way power divider for partially parallel feed in single layer slotted waveguide arrays," *IEICE Trans. Commun.*, vol. E81-B, no. 6, pp. 1248-1253, June. 1998.) For instance, the SIW 1-to-8 power divider 3800 of FIG. 37, which has one input 3702 and eight outputs 3704, is noticeably compact. FIG. 38A illustrates the simulated phase balance and FIG. 38B illustrates the simulated amplitudes at the output ports 3804 of 1-to-8 power divider 3700.

Figure 39:
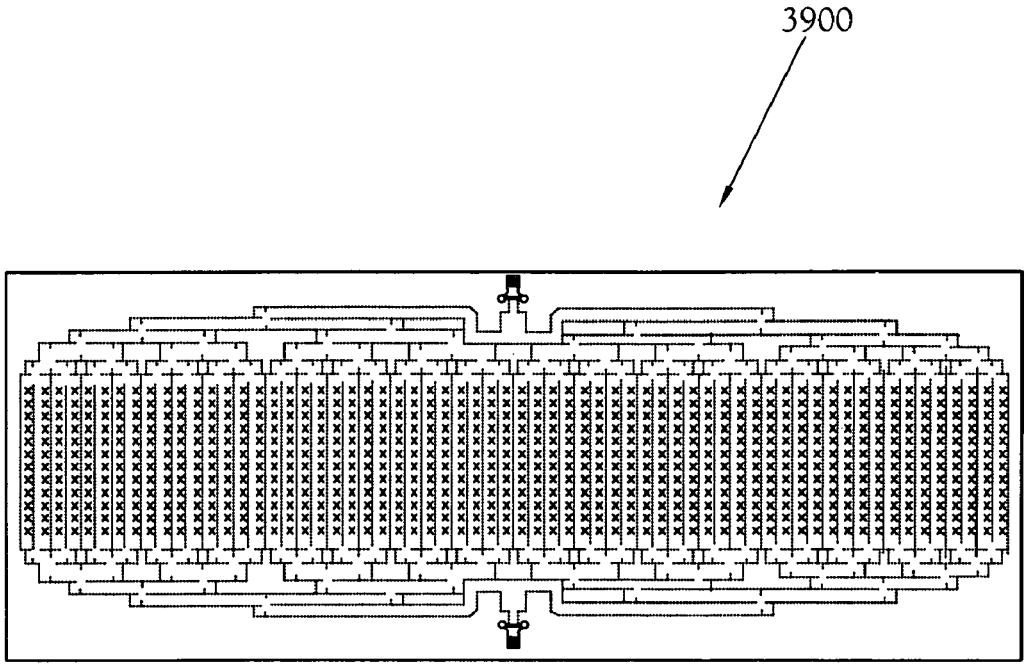
FIG. 39 illustrates a top plan view of a 12×64 SIW slot full antenna array according to the present invention.

FIG. 39 illustrates a 12×64 SIW full slot array antenna 3900. Compared to the 12×16 SIW slot sub-array 2900, the 12×64 SIW full slot array antenna 3900 has four times the number of radiating elements. However, the size of feed network is greatly reduced due to the utilization of compact junctions and narrower SIWs. As a result of increasing the number of radiating waveguides to 64, the loss of the feed network has significantly increased to a point where further lateral expansion of the array size produces only marginal gain improvements. To compensate for the increased feed loss and to establish the noise figure of the receiving antenna, low-noise amplifiers (LNAs) are required to combine the outputs of more sub-arrays.

Figure 40:
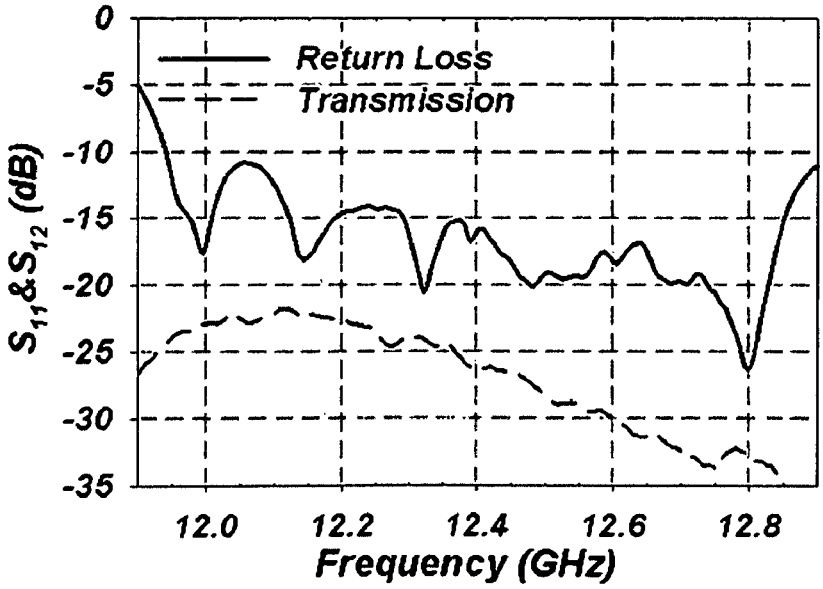
FIG. 40 the measured return loss and termination loss of the 12×64 SIW slot full antenna array of FIG. 39.
Figure 41A:
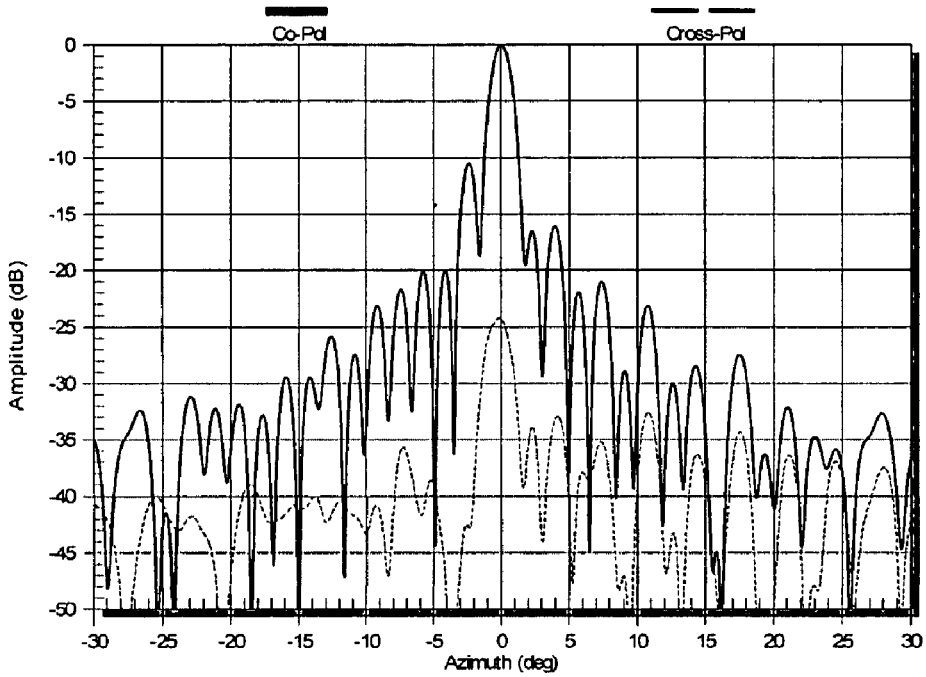
FIG. 41A is an azimuth cut the measured radiation patterns of the 12×64 SIW slot full antenna array of FIG. 39 at 12.2 Ghz.
Figure 41B:
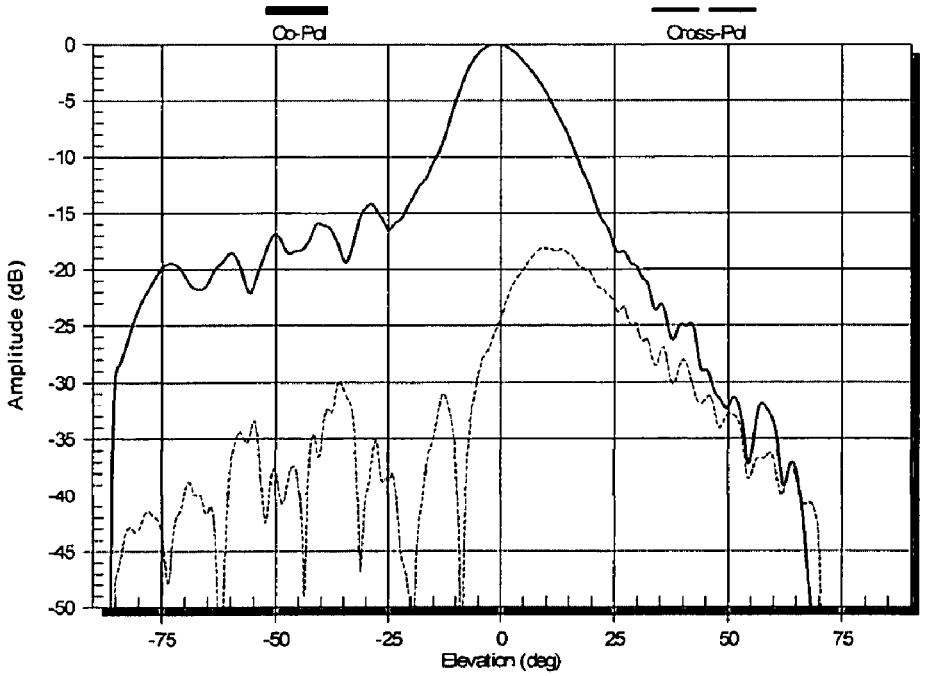
FIG. 41B is an elevation cut of the measured radiation patterns of the 12×64 SIW slot full antenna array of FIG. 39 at 12.2 Ghz.
Figure 42A:
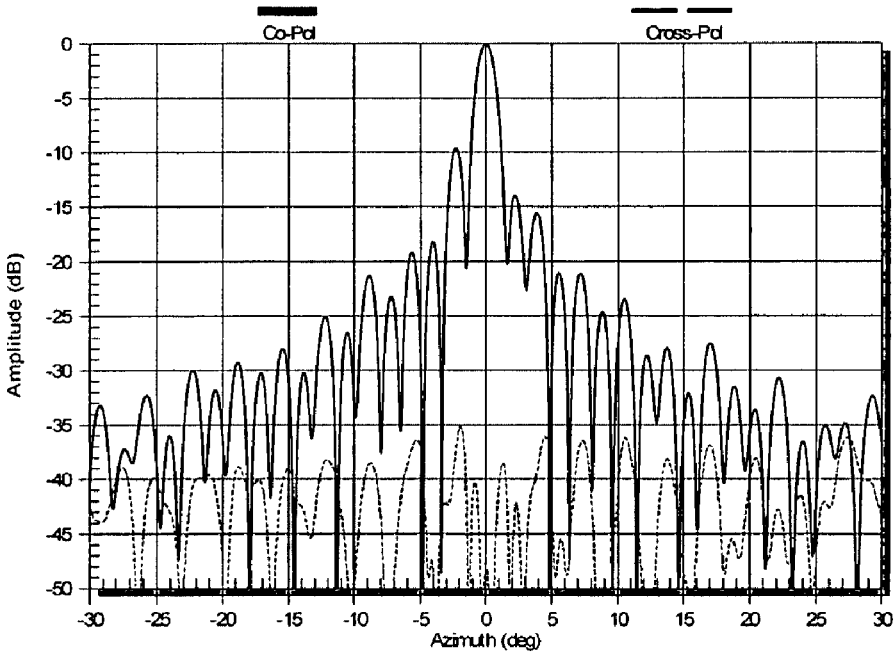
FIG. 42A is an azimuth cut the measured radiation patterns of the 12×64 SIW slot full antenna array of FIG. 39 at 12.45 Ghz.
Figure 42B:
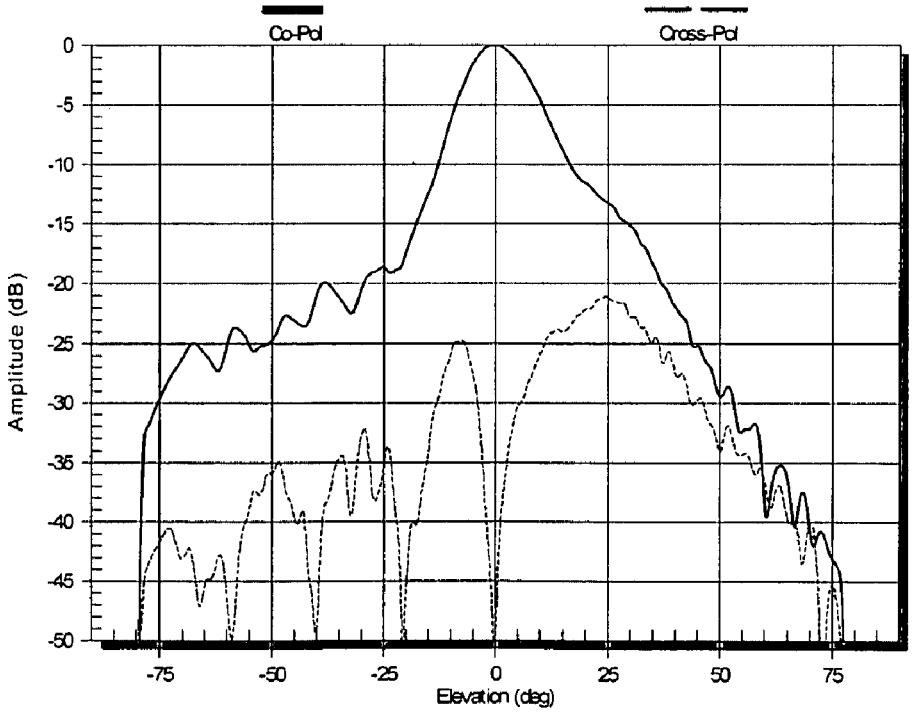
FIG. 42B is an elevation cut of the measured radiation patterns of the 12×64 SIW slot full antenna array of FIG. 39 at 12.45 Ghz.
Figure 43A:
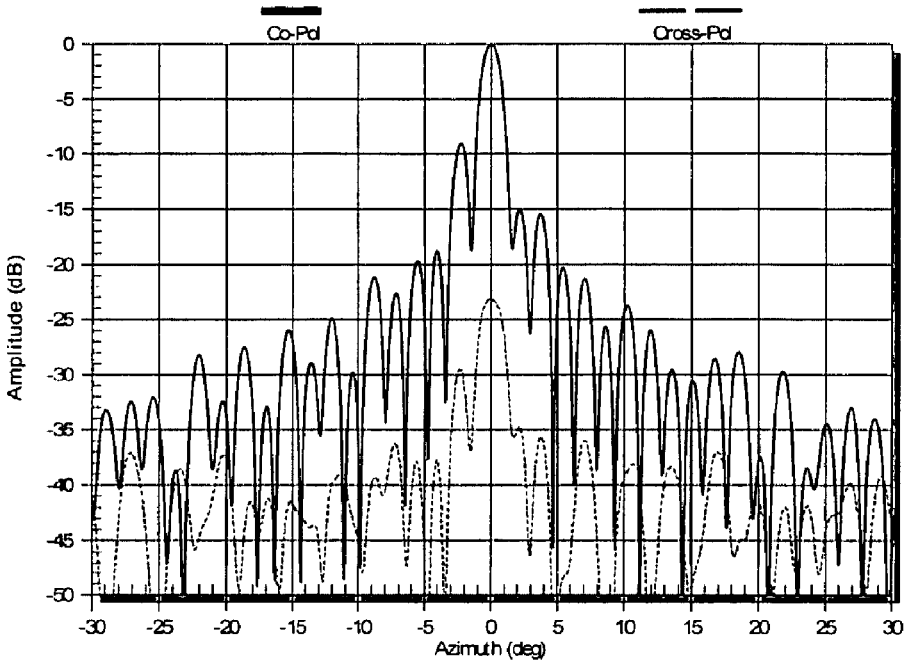
FIG. 43A is an azimuth cut the measured radiation patterns of the 12×64 SIW slot full antenna array of FIG. 39 at 12.7 Ghz.
Figure 43B:
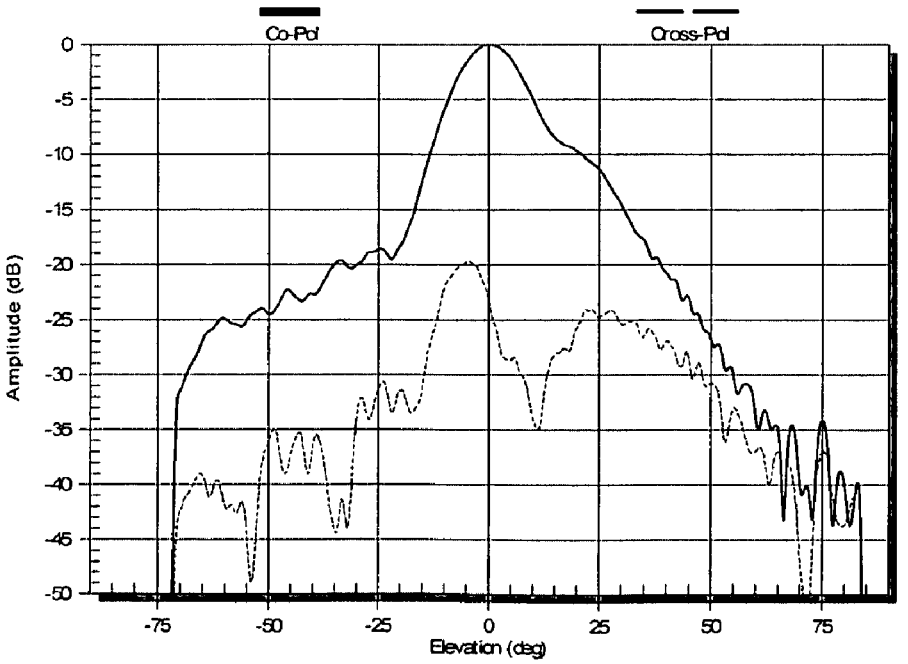
FIG. 43B is an elevation cut of the measured radiation patterns of the 12×64 SIW slot full antenna array of FIG. 39 at 12.7 Ghz.

FIG. 40 shows the measured return loss and termination losses of the 12×64 SIW slot full-array antenna 3900. By using SIW junctions with narrower widths, a wide bandwidth has been achieved. As with the 12×16 SIW slot sub-array 292900, the radiation patterns of the 12×64 SIW slot full-array antenna 3900 were evaluated using near-field measurements. FIG. 41A illustrates the measured LHCP radiation pattern for the azimuth cut and FIG. 41B illustrates the measured LHCP radiation pattern for the elevation cut for 12.2 GHz. FIG. 42A illustrates the measured LHCP radiation pattern for the azimuth cut and FIG. 42B illustrates the measured LHCP radiation pattern for the elevation cut for 12.45 GHz. FIG. 43A illustrates the measured LHCP radiation pattern for the azimuth cut and FIG. 43B illustrates the measured LHCP radiation pattern for the elevation cut for 12.7 GHz. The measured radiation patterns were close to the simulated results over the range of 12.2 GHz to 12.7 GHz. The measured LHCP radiation patterns demonstrate excellent axial ratio performance at the center frequency. Comparing their performance to that of a standard gain horn, approximately 28 dBi gain has been achieved. The loss of the feed network is around 3 dB, which is very close to the predicted insertion loss values according to the design charts detailed above. Similar results were measured for the RHCP case as well.

In the azimuth cut, a very narrow beam with a relatively high side lobe levels is observed, but this is reduced by tapering the feed for each radiating SIW. In the elevation cut, however, fewer elements are used and as expected a wider beam has been measured. Due to the tapering size of the radiating slots, a much lower side lobe level (greater than 18 dB down) is achieved compared to the side lobe level of 12×16 SIW slot sub-array 2900. At the center frequency, the beam points exactly to 45°. FIGS. 38B, 39B, and 40B are centered at the beam location angle. Similar to the measured results of the 12×16 SIW slot sub-array 2900, a frequency dependent beam squint has been observed here as well for the 12×64 SIW slot full-array 3900.

To enhance and render a low profile structure for DHCP reception, leaky-wave antenna designs with "X" shaped slotted waveguide have been extensively pursued. See, for example, A. J. Simmons, "Circularly Polarized Slot Radiators," IRE Trans. on Antennas and Propagation., vol. 5, pp. 31-36, January 1957; W. J. Getsinger, "Elliptically polarized leaky-wave array," IRE Trans. on Antennas and Propagation., vol. 10, pp. 165-171, March 1962; J. Hirokawa, M. Ando, N. Goto, N. Takahashi, T. Ojima, and M. Uematsu, "A Single-Layer Slotted Leaky Waveguide Array Antenna for Mobile Reception of Direct Broadcast from Satellite," IEEE Trans. Vehicular Tech., vol. 44, pp. 749-755, November 1995; and K. Sakakibara, Y. Kimura, J. Hirokawa, M. Ando, and N. Goto, "A Two-Beam Slotted Leaky Waveguide Array for Mobile Reception of Dual-Polarization DBS," IEEE Trans. Vehicular Tech., vol. 48, pp. 1-7, January 1999.

Figure 44:
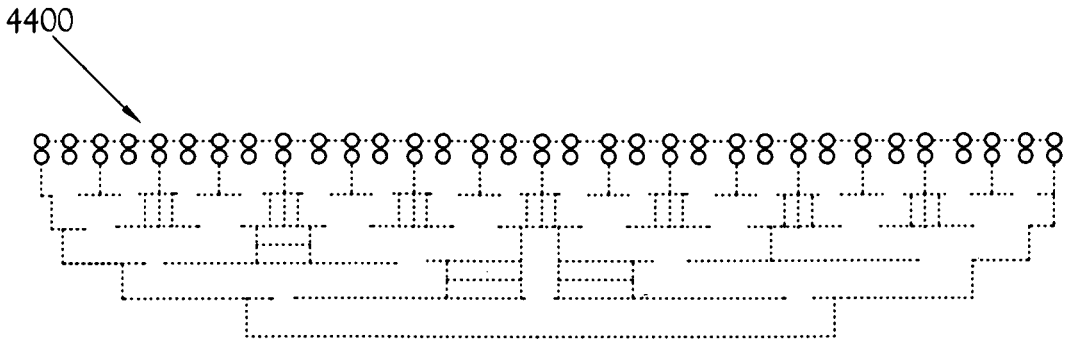
FIG. 44 illustrates a top plan view one embodiment of back-to-back 1-to-32 SIW feed networks according to the present invention.
Figure 45:
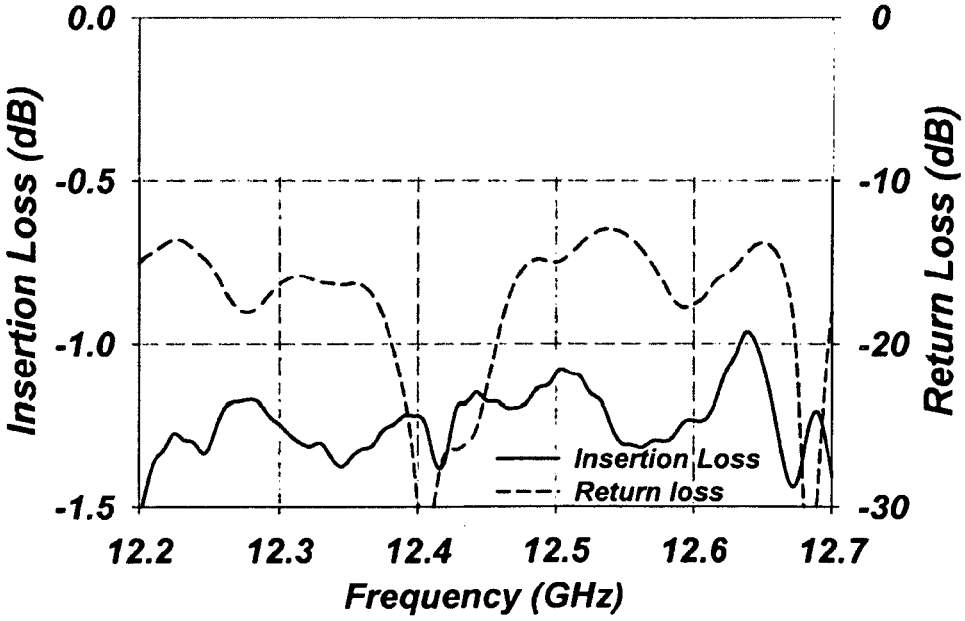
FIG. 45 graphs the measured insertion loss and return loss in the back-to-back 1-to-32 SIW feed networks of FIG. 44.

FIG. 44 illustrates a complete binary feeding network 4400 with 5 combining stages and 32 output waveguides. As previously discussed, binary feeds achieve excellent match, wide bandwidth, and output phase balance. The binary feeding network uses compact SIW "T"-junctions and compact SIW "π"-junctions translated as previously described. The binary feeding network provides an excellent return loss and the measured back to back insertion loss is less than 1.5 dB across the DBS band, as shown in FIG. 45.

Based on previous loss analysis of the SIW, the minimum insertion loss of antenna array feed network is achieved upon using thick low loss dielectric substrates. In addition, the leakage loss can be reduced to several orders of magnitude less than the dielectric and conductor losses by carefully selecting the spacing and diameter of the plated via holes, e.g. close to 0.01 dB/m. Both dielectric and conductor losses are reduced by using a larger "a" dimension of SIW. In the present design, dielectrics with $\epsilon_r$~2.2 and a thickness of 125 mil are used to provide ~ a 0.5 dB/m conductor loss for a SIW with an $a_{eq}$ dimension width of 15.1 mm. The dielectric loss tangent is assumed to be less than 0.001, which still accounts for about 1.75 dB/m dielectric loss. The diameter of the via holes is selected to be 1.25 mm and the spacing is twice its diameter to stay away from "overloading" the substrate with plated vias. According to these dimensions, a leakage loss factor of around 0.01 dB/m is calculated, which is insignificant when compared to other losses. An overall loss of 2.5 dB/m was measured.

Figure 46:
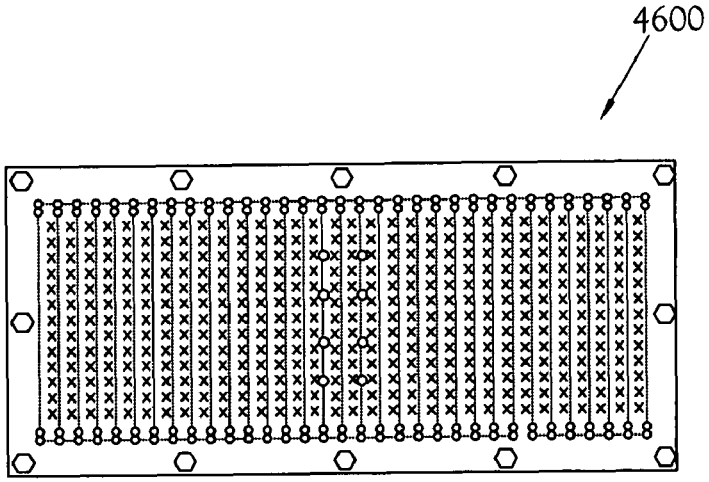
FIG. 46 illustrates a top plan view one embodiment of a folded 13×32 SIW slot full antenna array according to the present invention.

FIG. 46 shows a top plan view of a 13×32 folded SIW slotted full-array antenna 4600, showing the radiating waveguide array. The estimated gain of the 13×32 folded SIW slotted full-array antenna 4600 is approximately 27 dBi. To achieve 32 dBi, multiple apertures are required, and it is necessary to add LNAs before combining the outputs of these shared aperture arrays. The bottom view of the 13×32 folded SIW slotted full-array antenna 4600 includes a compatible feed network, such as the binary feeding network 4400 of FIG. 44.

Figure 47:
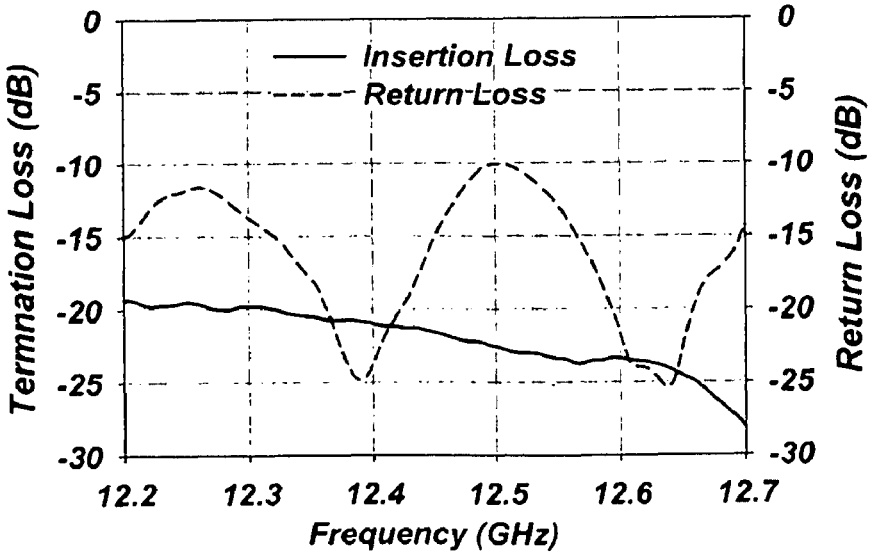
FIG. 47 graphs the measured insertion loss and return loss in the folded 13×32 SIW slot full antenna array of FIG. 46.

FIG. 47 shows the measured return loss and termination loss for the 13×32 folded SIW slotted full-array antenna 4600. From FIG. 47, it will be appreciated that the 13×32 folded SIW slotted full-array antenna 4600 achieves a wide bandwidth. In addition, the radiation patterns of the 13×32 folded SIW slotted full-array antenna 4600 were evaluated over the 12.2 GHz to 12.7 GHz frequency range using near-field measurements.

Figure 48A:
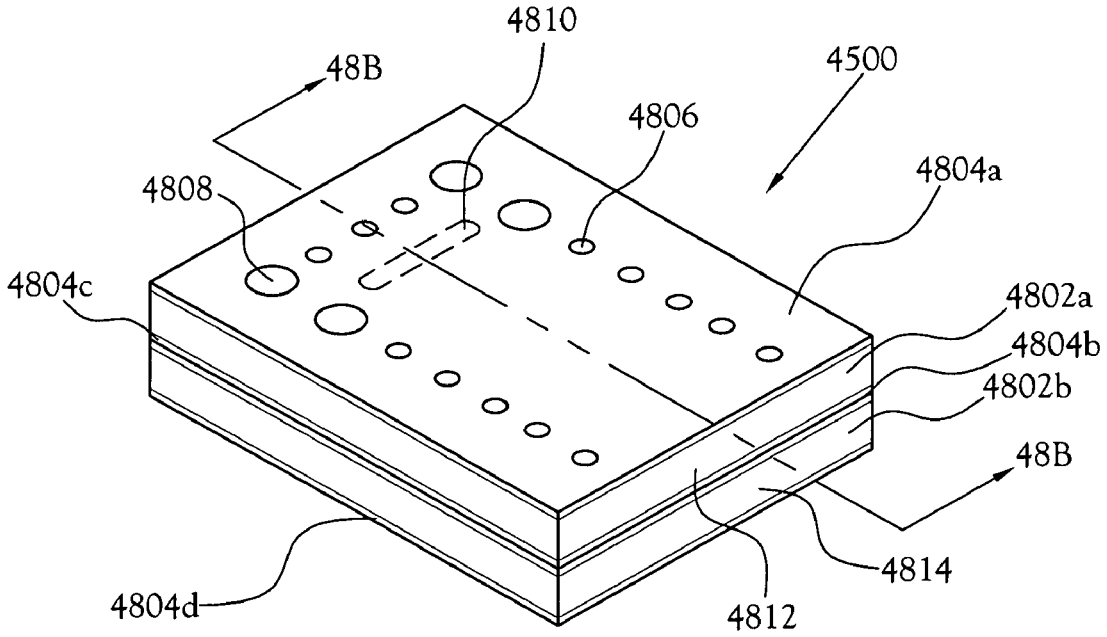
FIG. 48A is a perspective view of one embodiment of a transition between two SIW layers according to the present invention.
Figure 48B:
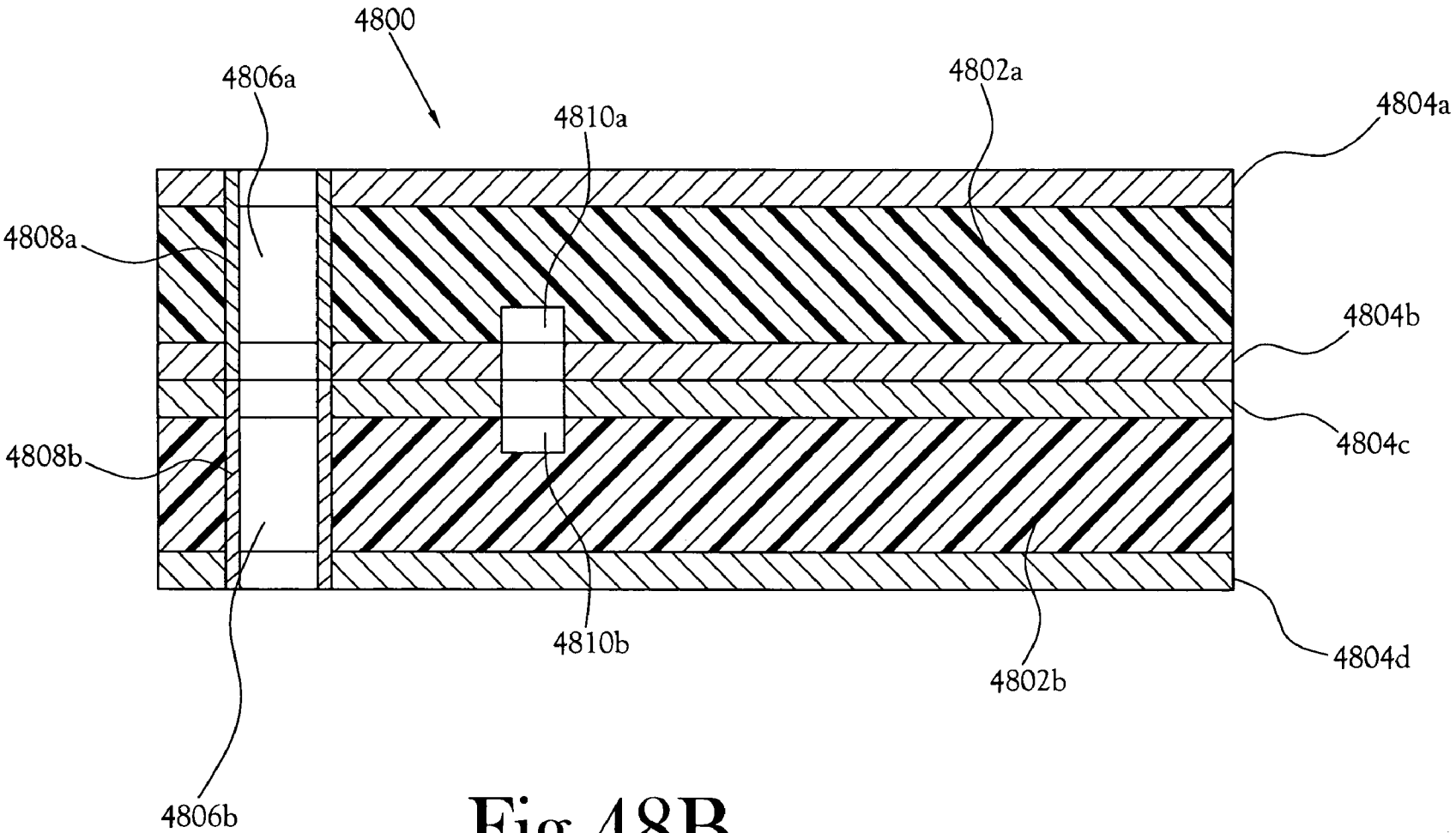
FIG. 48B is a sectional side elevation view of the transition of FIG. 48A, taken along section line B-B.

FIG. 48A details a transition 4800 between two SIW layers. In the, such as would be used to fabricate the folded SIW slotted full-array 4800 using multi-layer laminates to fold the feed network to the back of the radiating elements. This arrangement reduces the longitudinal size which further shrinks the overall height of the antenna when mechanically steered in the elevation plane. The folded SIW slotted full-array structure 4800 is fabricated from a separate first layer 4802*a* and a second layer 4802*b*, each layer having a metal plating 4804*a*, 4804*b*, which are joined during assembly. The radiating SIW layer is fabricated on one layer and the feeding network SIW is fabricated on the other layer using a plurality of plated via 4806 are provided to define the sidewalls of the waveguide structures. Transverse coupling slots 4810 are cut in the broad wall of SIW at the end of each SIW output to couple to the feeding network to the radiating waveguides. The feeding network is folded to the back of the radiating elements to provide size reduction. Using a very thin layer of bonding film, the two layers 4802*a*, 4802*b* are then bonded with the coupling slots 4810 facing each other, and, as a result, the output to the radiating waveguide 4812 and the input from the feeding network 4814 are stacked. In the illustrated embodiment, a plurality of screw holes 4808 through the two layers 4802*a*, 4802*b* are provided around the coupling slots 4810 to allow the two layers 4802*a*, 4802*b* to be mechanically secured, if necessary. Because the outputs of the feeding network and the radiating waveguides have the same a dimensions, the transition through layers provides excellent match over a wide bandwidth. FIG. 48B illustrates a cross-section of the translation 4800 showing the location of the coupling slots 4810*a*, 4810*b* at the interface between the two layers 4802*a*, 4802*b*. Also visible in this illustration is metal-plating 4808*a*, 4808*b* lining the vias 4806*a*, 4806*b*.

Figure 49A:
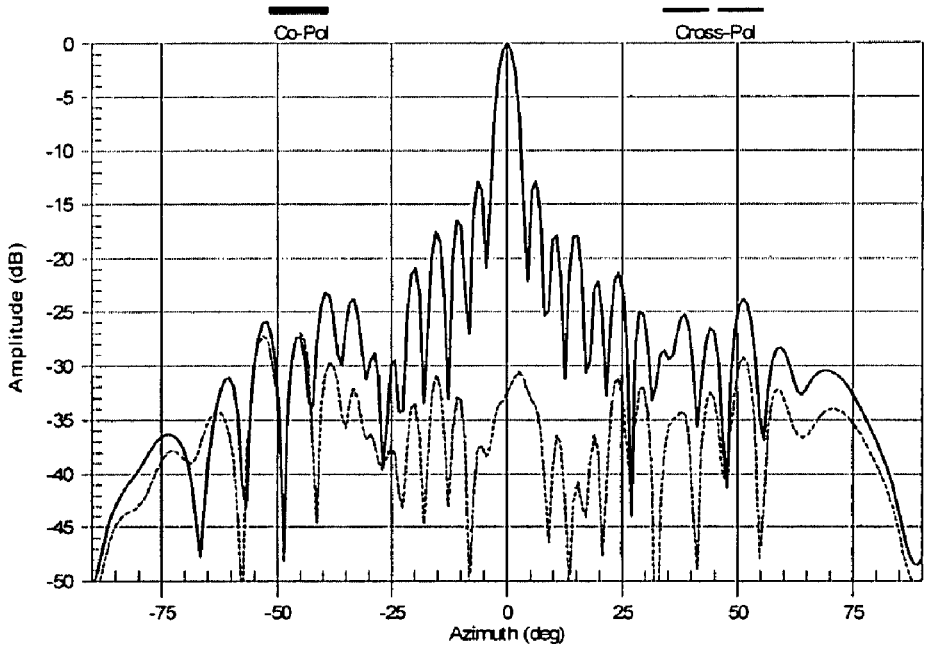
FIG. 49A is an azimuth cut of the measured radiation patterns of the folded 13×32 SIW slot full antenna array of FIG. 46 for at 12.45 Ghz.
Figure 49B:
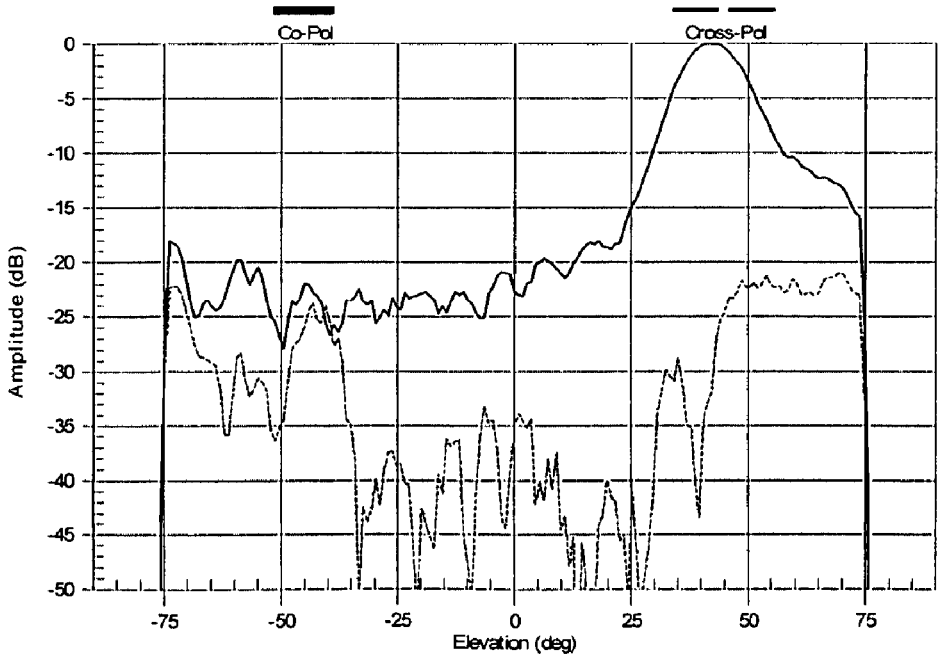
FIG. 49B is an elevation cut of the measured radiation patterns of the folded 13×32 SIW slot full antenna array of FIG. 46 at 12.45 Ghz.

FIGS. 49A and 49B show a sample of the measured results, which demonstrate excellent axial ratio performance at the center frequency for the LHCP at 12.45 GHz. Comparing their performance to that of a standard gain horn, approximately 26.5 dBi gain has been achieved over the band. Similar results were measured for the RHCP case.

In the azimuth cut, shown in FIG. 49A, a very narrow beam with a relatively high side lobe levels is measured, but this is reduced by tapering the feed for each radiating SIW. In the elevation cut, shown in FIG. 41B, fewer elements are used and a wider beam is observed. Due to the tapering size of the radiating slots, a much lower side lobe level (greater than 18 dB down) is achieved when compared to that of previous sub-array designs. (See S. Yang, S. H. Suleiman, and A. E. Fathy, "Ku-band Slot Array for Low Profile Mobile DBS Applications: Printed vs. Machined," *Proc. Antennas and Propagation Society Int'l Symposium*, Washington, D.C., USA. July 2006). At the center frequency, the beam points at 42°. As can be seen, a frequency dependent beam squint appears, consistent with the simulated results. The following table summarizes the near field measurement results of the 13×32 folded SIW slot full-array.

| Frequency | Beam Tilt | LHCP Gain | −3 dB AZ BW | −3 dB EL BW |
|---|---|---|---|---|
| 12.2 GHz | 48.68 deg | 26.07 dBi | 4.28 deg | 14.8 deg |
| 12.45 GHz | 41.16 deg | 26.52 dBi | 3.73 deg | 14.29 deg |
| 12.7 GHz | 34.64 deg | 26.43 dBi | 3.39 deg | 14.07 deg |

By folding the SIW feeding network to the back of the radiating cross-slot leaky-wave antennas, a size reduction of approximately 50% is achieved. The interlayer electromagnetic coupling between the radiating and feeding guides developed by the present inventors tolerates slight misalignments between two layers. The developments described herein have led to a low profile antenna, with a height of less than 3 inches, and surmounts to about 32 dB gain when splitting apertures, i.e., combining parallel apertures, as indicated in S. Yang and A. E. Fathy, "Cavity-Backed Patch Shared Aperture Antenna Array Approach for Mobile DBS Applications," 2006 *IEEE AP-S Int'l Symposium on Antennas and Propagation*, Albuquerque, N.Mex., Jul. 13-17, 2006. The measured results show about 3 dB overall insertion loss due to the feeding network. The aperture area is doubled by combining two parallel apertures and embedding LNAs after each sub-array to minimize noise figures. This antenna design circumvents typical phased array gain drop and cross-polarization degradation associated with steering.

From the foregoing description, it will be recognized by those skilled in the art that a substrate integrated waveguide slot full-array antenna fabricated using both single- and multi-layer printed circuit board technology has been provided. The substrate integrated waveguide slot full-array antenna reduces the overall bulk, weight, and height when compared to conventional metallic waveguide antenna arrays. In addition, the use of printed circuit board technology allows cost-effective and precise manufacturing of the antenna array. By taking advantage of the inherent beam tilt-angle established by dimensional parameters of the radiating elements, the physical steering requirements for signal reception are reduced. Still further, the SIW slot array antennas utilizing emulated waveguide feed structures according to the present invention have lower insertion loss compared to planar printed antennas.

While the present invention has been illustrated by description of several embodiments and while the illustrative embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the scope or spirit of the general inventive concept.

Having described the aforementioned invention, what is claimed is:

1. A substrate integrated waveguide array antenna for transmitting and receiving signals, said substrate integrated waveguide array antenna comprising:

a substrate fabricated from a low loss dielectric material, said substrate having a top surface and a bottom surface, said top surface and said bottom surface having a metal plating;

an array of radiating waveguide elements integrated with said substrate, each radiating waveguide elements comprising a plurality of substantially linearly-aligned cross-slots through said metal plating of said top surface, a first waveguide sidewall running parallel to said plurality of cross-slots, and a second waveguide sidewall running parallel to said plurality of cross-slots, said first waveguide sidewall and said second waveguide sidewall being on opposite sides of and spaced-apart from said plurality of cross-slots, said first waveguide sidewall being spaced apart from said second waveguide sidewall by a selected distance, said first waveguide sidewall and said second waveguide sidewall comprising a plurality of waveguide sidewall vias through said substrate, each of said waveguide sidewall vias being metal-lined, said waveguide sidewall vias being spaced-apart from each other, each said cross-slot within said plurality of substantially linearly-aligned cross-slots being spaced apart from neighboring said cross-slots to produce circular polarization at a selected tilt-angle when excited; and a binary feeding network integrated with said substrate, said binary feeding network having a plurality of outputs, each output of said plurality of outputs being coupled to one radiating waveguide element of said array of radiating waveguide elements, said binary feeding network comprising a plurality of feed sidewalls forming junctions adapted to divide the power of transmitted signals and to combine the power of received signals, said plurality of feed sidewalls forming a series of cooperating pairs of feed sidewalls spaced apart from each other by a selected distance, each said feed sidewall comprising a plurality of feed sidewall vias through said substrate, each said feed sidewall via being metal-lined, each said feed sidewall via being spaced-apart from neighboring feed sidewall vias in said feed sidewall.

2. The substrate integrated waveguide array antenna of claim 1 wherein said binary feeding network defines at least one junction selected from the group consisting of substrate integrated waveguide "T"-junctions, substrate integrated waveguide "π"-junctions, and substrate integrated waveguide "Y"-junctions.

3. The substrate integrated waveguide array antenna of claim 1 further comprising a grounded-coplanar-waveguide-to-substrate-integrated-waveguide transition to couple the transmission from a planar structure to said binary feeding network, said grounded-coplanar-waveguide-to-substrate-integrated-waveguide transition having a grounded-coplanar-waveguide interfacing with a substrate integrated waveguide region.

4. The substrate integrated waveguide array antenna of claim 3 wherein said grounded-coplanar-waveguide-to-substrate-integrated-waveguide transition includes a substantially "L"-shaped coupling slot disposed proximate to a short-circuit termination of said substrate integrated waveguide region.

5. The substrate integrated waveguide array antenna of claim 3 wherein said grounded-coplanar-waveguide-to-substrate-integrated-waveguide transition includes an impedance transformer disposed within said grounded-coplanar-waveguide region.

6. The substrate integrated waveguide array antenna of claim 3 wherein said grounded-coplanar-waveguide-to-substrate-integrated-waveguide transition includes a series of metal-plated vias defining transition sidewalls, said grounded-coplanar-waveguide-to-substrate-integrated-waveguide transition further comprising a tapered coupling slot disposed proximate to said transition sidewalls such that an electric field across said tapered coupling slot is substantially perpendicular to said transition sidewalls.

7. The substrate integrated waveguide array antenna of claim 1 wherein said transmission is a direct broadcast satellite signal, said tilt-angle being approximately 45° such that said substrate integrated waveguide array antenna only requires a physical elevation steering range of ±25°.

8. A substrate integrated waveguide array antenna for transmitting and receiving signals, said substrate integrated waveguide array antenna comprising:

a first substrate fabricated from a low loss dielectric material, said first substrate having a top surface and a bottom surface;

a second substrate fabricated from a low loss dielectric material, said second substrate having a top surface and a bottom surface, one of said second substrate top surface and said second substrate bottom surface secured to one of said first substrate surface and said first substrate bottom surface thereby cooperatively defining a pair of inner surfaces and a pair of outer surfaces, each of said pair of outer surfaces having a metal plating, said pair of inner surfaces having a metal plating therebetween;

an array of radiating waveguide elements integrated with said first substrate, each radiating waveguide elements comprising a plurality of substantially linearly-aligned cross-slots etched into said metal plating of said top surface, a first waveguide sidewall running parallel to said plurality of cross-slots, and a second waveguide sidewall running parallel to said plurality of cross-slots, said first waveguide sidewall and said second waveguide sidewall being on opposite sides of and spaced-apart from said plurality of cross-slots, said first waveguide sidewall being spaced apart from said second waveguide sidewall by a selected distance, said first waveguide sidewall and said second waveguide sidewall comprising a plurality of waveguide sidewall vias through said first substrate, each of said waveguide sidewall vias being metal-lined, said waveguide sidewall vias being spaced-apart from each other to create a leaky-wave antenna, each said cross-slot within said plurality of substantially linearly-aligned cross-slots being spaced apart from neighboring said cross-slots to produce circular polarization at a selected tilt-angle when excited, each radiating waveguide element of said array of radiating waveguide elements having a waveguide slot defined in said first substrate inner surface; and a binary feeding network integrated with said second substrate, said binary feeding network having a plurality of outputs, each output of said plurality of outputs having a feed slot defined in said second substrate inner surface, each said feed slot being aligned with a corresponding said waveguide slot when said first substrate and said second substrate are secured together, said feed slot and said waveguide slot cooperating to couple said binary feeding network to said array of radiating waveguide elements, each output of said plurality of outputs being coupled to one radiating waveguide element of said array of radiating waveguide elements, said binary feeding network comprising a plurality of feed sidewalls forming junctions adapted to divide the power of transmitted signals and to combine the power of received signals, said plurality of feed sidewalls forming a series of cooperating pairs of feed sidewalls spaced apart from each other by a selected distance, each said feed sidewall comprising a plurality of feed sidewall vias through said substrate, each said feed sidewall via being metal-lined, each said feed sidewall via being spaced-apart from neighboring feed sidewall vias in said feed sidewall.

9. The substrate integrated waveguide array antenna of claim 8 wherein said binary feeding network defines at least one junction selected from the group consisting of substrate integrated waveguide "T"-junctions, substrate integrated waveguide "π"-junctions, and substrate integrated waveguide "Y"-junctions.

10. The substrate integrated waveguide array antenna of claim 8 said metal plating between said pair of inner surfaces includes a first metal plating on said first substrate inner surface and a second metal plating on said second substrate inner surface.

11. The substrate integrated waveguide array antenna of claim 8 further comprising a grounded-coplanar-waveguide-to-substrate-integrated-waveguide transition to couple the transmission from a planar structure to said binary feeding network, said grounded-coplanar-waveguide-to-substrate-integrated-waveguide transition having a grounded-coplanar-waveguide interfacing with a substrate integrated waveguide region.

12. The substrate integrated waveguide array antenna of claim 11 wherein said grounded-coplanar-waveguide-to-substrate-integrated-waveguide transition includes a substantially "L"-shaped coupling slot disposed proximate to a short-circuit termination of said substrate integrated waveguide region.

13. The substrate integrated waveguide array antenna of claim 11 wherein said grounded-coplanar-waveguide-to-substrate-integrated-waveguide transition includes an impedance transformer disposed within said grounded-coplanar-waveguide region.

14. The substrate integrated waveguide array antenna of claim 11 wherein said grounded-coplanar-waveguide-to-substrate-integrated-waveguide transition includes a series of metal-plated vias defining transition sidewalls, said grounded-coplanar-waveguide-to-substrate-integrated-waveguide transition further comprising a tapered coupling slot disposed proximate to said transition sidewalls such that an electric field across said tapered coupling slot is substantially perpendicular to said transition sidewalls.

15. The substrate integrated waveguide array antenna of claim 8 wherein said transmission is a direct broadcast satellite signal, said tilt-angle being approximately 45° such that said substrate integrated waveguide array antenna only requires a physical elevation steering range of ±25°.

* * * * *